US011365485B2

(12) United States Patent
Bahar et al.

(10) Patent No.: US 11,365,485 B2
(45) Date of Patent: Jun. 21, 2022

(54) OZONE GENERATOR SYSTEM

(71) Applicant: Xergy Inc., Harrington, DE (US)

(72) Inventors: Bamdad Bahar, Georgetown, DE (US); Jacob Zerby, Harbeson, DE (US)

(73) Assignee: FFI Ionix IP, Inc., Wilmington, DE (US)

( * ) Notice: Subject to any disclaimer, the term of this patent is extended or adjusted under 35 U.S.C. 154(b) by 0 days.

(21) Appl. No.: 15/698,842

(22) Filed: Sep. 8, 2017

(65) Prior Publication Data

US 2017/0370013 A1 Dec. 28, 2017

Related U.S. Application Data

(63) Continuation-in-part of application No. PCT/US2016/063699, filed on Nov. 23, 2016.

(60) Provisional application No. 62/385,176, filed on Sep. 8, 2016, provisional application No. 62/258,945, filed on Nov. 23, 2015, provisional application No. 62/300,074, filed on Feb. 26, 2016, provisional application No. 62/353,545, filed on Jun. 22, 2016, provisional application No. 62/373,329, filed on Aug. 10, 2016, provisional application No. 62/385,175, filed on Sep. 8, 2016.

(51) Int. Cl.

| | |
|---|---|
| ***C25B 15/02*** | (2021.01) |
| ***C25B 1/13*** | (2006.01) |
| ***C25B 15/08*** | (2006.01) |
| ***C25B 9/23*** | (2021.01) |
| ***C25B 9/70*** | (2021.01) |

(52) U.S. Cl.

CPC ..... *C25B 15/02* (2013.01); *C25B 1/13* (2013.01); *C25B 9/23* (2021.01); *C25B 9/70* (2021.01); *C25B 15/08* (2013.01)

(58) Field of Classification Search

CPC ..... C25B 1/04–13

See application file for complete search history.

(56) References Cited

U.S. PATENT DOCUMENTS 5,972,196 A * 10/1999 Murphy ..... B01D 53/22 204/157.15
6,132,573 A * 10/2000 Cubukcu ..... B01D 53/326 204/262
2007/0207071 A1* 9/2007 Silverman ..... A61L 2/202 422/186.07

(Continued)

FOREIGN PATENT DOCUMENTS

GB 2534656 B * 7/2018

*Primary Examiner* — Salil Jain

(74) *Attorney, Agent, or Firm* — Invention To Patent Services; Alex Hobson

(57) ABSTRACT

An ozone generator system utilizes an electrochemical cell to produce and control ozone concentrations within an enclosure or to supply ozone to a flow conduit. The enclosure may he coupled with a flow conduit that carries the produced ozone to a desired location. An enclosure may be a sterilization chamber and the concentration of ozone produced by the ozone generating system may be sufficient to sterilize articles within the enclosure. An oxygen control electrolyzer cell and/or humidity control electrolyzer cell may be coupled with the enclosure to further control the environment of the enclosure. A humidity control electrolyzer cell may be fluidly coupled with the ozone generator to supply humidity for reaction on the anode of the ozone generator.

2 Claims, 27 Drawing Sheets

(56) References Cited

U.S. PATENT DOCUMENTS

| | | | | |
|---|---|---|---|---|
| 2009/0185959 | A1* | 7/2009 | Weber | C01B 13/11<br>422/107 |
| 2013/0026096 | A1* | 1/2013 | Nitta | C02F 1/006<br>210/638 |
| 2015/0096884 | A1* | 4/2015 | Shealy | C25B 9/10<br>204/252 |

* cited by examiner

PRIOR ART

- Anode:

$2H_2O \rightarrow 4H^+ + O_2 + 4e^-$ $E_0 = 1.23\,V$ $3H_2O \rightarrow 6H^+ + O_3 + 6e^-$ $E_0 = 1.51\,V$ $H_2O + O_2 \rightarrow 2H^+ + O_3 + 2e^-$ $E_0 = 2.08\,V$

- Cathode:

$2H^+ + 2e^- \rightarrow H_2$ $E_0 = 0\,V$

OZONE GENERATOR SYSTEM

CROSS REFERENCE TO RELATED APPLICATIONS

This application is a continuation in part of PCT application no. PCT/US2016063699, filed on Dec. 23, 2016 which claims the benefit of U.S. provisional patent application No. 62/258,945, filed on Nov. 23, 2015, U.S. provisional patent application No. 62/300,074, filed on Feb. 26, 2016, U.S. provisional patent application No. 62/353,545, filed on Jun. 22, 2016, U.S. provisional patent application No. 62/373,329, filed on Aug. 10, 2016 and U.S. provisional patent application No. 62/385,175, filed on Sep. 8, 2016, this application also claims the benefit of provisional patent application No. 62/385,176, filed on Sep. 8, 2016, entitled Ozone Generator System; the entirety of which is hereby incorporated by reference herein; the entirety of all applications are hereby incorporated by reference herein.

BACKGROUND OF THE INVENTION

This invention was made with government support under Government Contract Grant No. DE-SC0015923 awarded by Department of Energy. The government has certain rights in the invention.

FIELD OF THE INVENTION

The present invention relates to an ozone generator system utilizing an electrochemical cell.

BACKGROUND

There are many types of enclosures that require environment control wherein the oxygen and/or the humidity level is controlled. For example, museum artifacts and documents are often stored in environmentally controlled enclosures to reduce degradation due to oxidation, rust and the like. In addition, produce and other consumer products and goods may benefit from storage in environment controlled enclosures, including refrigerated items. Electrolyzer cells utilizing membrane electrode assemblies can be used in an electrolysis mode to reduce oxygen with an increase in humidity, or decrease humidity with an increase in oxygen. In most enclosure applications for valuables and produce however, it is desirable to reduce oxygen and also reduce humidity levels. There exists a need for an energy efficient, durable, quiet and effective environment control system for enclosures.

Current ozone production systems employ a corona discharge, as generally shown in FIG. 1. Corona discharge requires a feed gas and can result in the production of undesirable gasses, such as NOx, and nitric acid. In a corona discharge system, voltage is applied to an electrode or across a pair of electrodes to excited oxygen molecules and produce ozone. Approximately 90% of the energy applied is lost in heat generation.

SUMMARY OF THE INVENTION

The invention is directed to an ozone generator system employing an electrochemical ozone generator. An exemplary ozone generator comprises a membrane electrode assembly having an anode, cathode and proton conducting layer between the anode and the cathode. When a voltage potential above a threshold, such as above about 1.5 volts, is produced across the anode and cathode, ozone may be produced by the electrochemical cell. Water molecules on the anode side are reacted to form ozone as well as protons and electrons. Protons travel through the membrane and recombine with oxygen on the cathode to produce water vapor and/or hydrogen.

Ozone generation is used in a wide range of disinfecting or sterilization applications. An electrochemical based ozone generation system has many benefits over a corona discharge ozone generation method. An electrochemical ozone generation system, as described herein, does not require a specific feed gas and will not produce hazardous NOx or nitric acid. In addition, the electrochemical ozone generation system will work over a wide range of humidity conditions. In addition, the air impermeable proton conducting layer between and anode and cathode prevents air from passing to the of the anode from the cathode side. Ozone can be generated directly from air and humidity within an enclosure, thereby eliminating the need for a feed gas that could contaminate the anode.

An exemplary ozone generator system, as describe herein, may be used in disinfecting or sterilization applications including, but not limited to, food processing, including food preparation, and packaging as well as in product or pharmaceutical manufacturing, medical instrument cleaning and sterilization and the like. Articles for disinfecting may be placed in an enclosure and a sufficiently high concentration of ozone may be produced tom a sufficient amount of time to sterilize the article within the enclosure. In another application, a flow of ozone is passed over an article or surface of an article requiring disinfecting. An enclosure may be configured with an electrochemical cell that creates a high concentration of ozone within the enclosure for movement over an article. An ozone generator system may incorporate an air moving device, such as a pump or fan to move ozone generated on the anode from the device onto an article or into an enclosure for subsequent use or for placing articles therein.

An exemplary ozone generator system, may comprise multiple cells, operating in parallel to provide great system reliability. In the event that one of the cells goes down or fails the other cells will produce adequate ozone and the entire system does not go down. Generated ozone is fed upstream of the unit, and results in precipitation of contaminants that can (a) be filtered out, and (b) protect the system from failure through component degradation.

An exemplary ozone generator system may comprise communication systems (and sensors) that are configured within the system to provide alarms and communicate with local operators to make sure the system is running at all times and maintained as appropriate. For example, an ozone sensor may be configured within an enclosure or within a conduit that passes produced ozone out from the system and may measure ozone concentration and relay this measured concentration back to a controller that may modulate the power or voltage of the electrochemical cell, and thereby control the amount of ozone produced. A controller may comprise a microprocessor or an electrical circuit for controlling the voltage potential of the electrochemical cell.

Sterilization is defined herein, as a process that eliminates by removal, or killing, or deactivating, all forms of life and other biological agents including transmissible agents that are present in a specified area of region, including surfaces, within a volume, within a fluid, or article including medications and compounds. Biological agents include, but are not limited to, prions, as well as viruses. Transmissible agents include, but are not limited to, fungi, bacteria, viruses, prions, spore forms, unicellular eukaryotic organisms such as Plasmodium, and the like. Sterilization is distinct from disinfection, sanitization, and pasteurization in that sterilization kills, deactivates, or eliminates all forms of life and other biological agents. Disinfecting may effectively eliminate a certain percentage of biological agents, or leaves a certain reduce concentration.

This application incorporates by reference, in their entirety, U.S. provisional patent applications No. 62/353,545, filed on Jun. 22, 2016, application No. 62258945 filed on Nov. 23, 2015 and application No. 62/373,329 filed on Aug. 10, 2016. This application incorporates by reference, in their entirety, the following: U.S. provisional patent application No. 62/171,331, filed on Jun. 5, 2015 and entitled Electrochemical Compressor Utilizing a Preheater; U.S. patent application Ser. No. 14/859,267, filed on Sep. 19, 2015, entitled Electrochemical Compressor Based Heating Element and Hybrid Hot Water Heater Employing Same; U.S. patent application Ser. No. 13/899,909 filed on May 22, 2013, entitled Electrochemical Compressor Based Heating Element And Hybrid Hot Water Heater Employing Same; U.S. provisional patent application No. 61/688,785 filed an May 22, 2012 and entitled Electrochemical Compressor Based Heat Pump For a Hybrid Hot Water Heater; U.S. patent application Ser. No. 14/303,335, filed on Jun. 12, 2014, entitled Electrochemical Compressor and Refrigeration System; U.S. patent application Ser. No. 12/626,416, filed an Nov. 25, 2009, entitled Electrochemical Compressor and Refrigeration System now U.S. Pat. No. 8,769,972; and U.S. provisional patent application No. 61/200,714, filed on Dec. 2, 2008 and entitled Electrochemical Compressor and Heat Pump System; the entirety of each related application is hereby incorporated by reference.

The U.S. provisional patent application No. 62/258,945, filed on Nov. 23, 2015, and PCT application US2016063699, both of which are hereby incorporated by reference in their entirety, describes a novel proton-exchange membrane (PEM) based solid polymer electrolyte electrochemical oxygen control (EOC) system that can deplete and control the oxygen from a closed container to levels sufficient for both disinfestation and preservation. With the use of this electrochemical process, many insects that infest raw agricultural products and other produce can be exterminated, without detriment to the quality of the produce and without deposition of harmful residue, by reducing the ambient oxygen to a controlled low level for several days. The electrochemical process features the use of a bipolar stack comprised of a selected number of PEM cells connected electrically in series and separated by an electrically conductive bipolar plate. Each cell contains a membrane and electrode assembly, consisting of an anode structure and cathode structure in intimate contact with a proton exchange membrane. When DC power is applied to the cell stack, electrons are supplied to the cathode, supporting reduction of oxygen at the cathode with the formation of water, and electrons removed from the anode, supporting oxygen evolution by the decomposition of water at the anode. The anode and cathode compartments are separated by the solid proton conducting layer or material which may comprise an ionomer which transports protons generated at the anode through the PEM to the cathode to complete the electrical circuit internally. Oxygen is depleted by recirculating the gas in the closed container over the cathode, and expelling the oxygen evolved at the anode by separating the oxygen from the recirculating anode water stream and venting it to the outside of the closed container. Nitrogen or other inert gas is added as makeup gas to avoid creating a negative pressure in the container. A unique feature of this process is that at a low oxygen concentration, the cell and stack cathode current becomes rate-limited in direct proportion to the oxygen level in the recirculating gas and can therefore be used as a measure of the container oxygen level. In the sensing/control scheme developed as part of this invention, the current is periodically allowed to rise to the diffusion limit in a "measure mode" and then reset according to the desired oxygen level, determined from a slope-intercept "measure mode" calibration curve, for a longer "control mode" period.

The invention is directed to an environment control system that employs an electrochemical cell(s) to effectively control oxygen and also control humidity within an enclosure. In one embodiment, oxygen concentration is reduced and humidity is reduced within an enclosure. In another embodiment, oxygen concentration is increased while humidity is increased. An exemplary environment control system utilizes oxygen and humidity control devices that are coupled with an enclosure to independently control the oxygen concentration and the humidity, RH, within the enclosure. An oxygen control device may be an oxygen depletion electrolyzer cell that reacts with oxygen and produces water through electrochemical reactions. In an alternate embodiment, an oxygen control device is operated as an oxygen increase device, wherein oxygen is produced within the enclosure from the reaction with water to form oxygen and protons. A dehumidification device may be a dehumidification electrolyzer cell, a humidification electrolyzer cell, a desiccator, a membrane separator, and/or a condenser. A controller may control the amount of voltage and/or current provided to the oxygen depletion electrolyzer cell and therefore the rate of oxygen reduction and may control the amount of voltage and/or current provided to the dehumidification electrolyzer cell and therefore control the rate of humidity reduction.

In an exemplary embodiment, an environment control system is coupled with an enclosure and comprises an oxygen depletion electrolyzer cell that reduces the oxygen concentration in an enclosure. An oxygen depletion electrolyzer cell comprises an ion conducting material, such as ionomer that transports cations or protons from an anode and a cathode, wherein the anode and cathode are configured on opposing sides of the ionomer. The cathode is in fluid communication with the enclosure and a power source is coupled with the anode and cathode to provide an electrical potential across the anode and the cathode to initiate electrolysis of water. Water is reacted to form oxygen and protons on the anode and the protons are transported across the ionomer, or cation conducting material, to the cathode where these protons react with oxygen at the cathode to form water, thereby depleting oxygen on the cathode side while producing water on the cathode side. As described herein, novel system configurations are employed to reduce and control the humidity within the enclosure that may be produced, at least in part, by the cathode of the oxygen depletion electrolyzer cell.

An exemplary environment control system may comprise an oxygen increase electrolyzer cell, wherein the anode is configured in fluid communication with the enclosure and produces oxygen from the reaction of water at the anode. An oxygen control electrolyzer cell may be run in either an oxygen depletion mode or an oxygen increase mode, depending on the potential applied across the anode and the cathode.

An exemplary environment control system comprises a humidification control device, such as a dehumidification device that reduces the humidification level of the enclosure either directly or indirectly. In an exemplary embodiment, the dehumidification device is a dehumidification electrolyzer cell that pumps water out of the enclosure or out of a conditioner chamber, or the humidity control portion of the conditioner chamber. Other dehumidification devices include a separator, such as a separator membrane that allows moisture to pass therethrough, but is substantially air impermeable and therefore prevents oxygen flow. A separator that is substantially air impermeable has no bulk flow of gas through the thickness of the separator and may have a Gurley Densometer time of 100 seconds or more. Model 4110N from Gurley Precision Instruments. Troy N.Y., for example. Other dehumidification devices include desiccants, condensers and any combination of the dehumidification devices described.

An exemplary environmental control system comprises a humidification electrolyzer cell, wherein the electrolyzer cell is run with the cathode in fluid communication with the enclosure or with the humidity control portion of a conditioning chamber. In one embodiment, a humidification electrolyzer cell produces moisture in a conditioner chamber and a separator membrane transfers this moisture to an oxygen control chamber.

In an exemplary embodiment, the oxygen control and/or the humidification electrolyzer, comprises an ionomer, such as a perfluorosulfonic acid polymer. The ionomer may be a composite comprising a support material that is coated and/or imbibed with the ionomer. The ionomer may be very thin, such as less than 25 microns, less than 20 microns and more preferably less than 15 microns. A thin ionomer is preferred as it will allow for higher rates of proton transport and better efficiency.

In an exemplary embodiment, a conditioner chamber is utilized to dehumidify gas that is introduce into the enclosure. A conditioner chamber, or portion thereof is in fluid communication with the enclosure and there may be one or more valves and/or fans or other air moving device to move gas between the conditioner chamber and the enclosure. In an exemplary embodiment, a conditioner chamber is separated into an oxygen control chamber and a humidity control chamber. A separator membrane may be configured between the oxygen control chamber and the humidity control chamber and allow humidity to pass from one chamber to the other. This separated conditioner chamber can effectively reduce humidity in the oxygen control chamber while simultaneously reducing humidity in the oxygen control chamber. When the oxygen control chamber is at a higher humidity level than the humidity control chamber, water vapor will be transferred through the separator membrane to the humidity control chamber, due to concentration gradients. The humidity control chamber may reduce the humidity level through one or more dehumidification devices, as described herein. For example, a dehumidification electrolyze cell may pump water out of the humidity control portion to maintain a very low level of humidity in the humidity control chamber, and therefore draw moisture from the oxygen control chamber through a separator. A separator may comprise an ionomer membrane and again, the ionomer membrane may be a reinforced ionomer membrane having a support material. A separator or moisture transmission material may be pleated or corrugated to provide a higher surface area of the opening to the enclosure. An exemplary separator is an ionomer, such as Nafion® membrane, from E.I. DuPont, Inc, Wilmington, Del., or Gore-Select® membrane from W.L. Gore and Associates, Inc., Newark, Del.

An oxygen control chamber, or as portion thereof, may be configured as an exchange conduit having an inlet from the enclosure and an outlet back into the enclosure. An exchange conduit may comprise a separator for transfer of moisture from the oxygen control chamber or exchange conduit to the humidity control chamber. An exchange conduit may extend within the conditioner chamber or the humidity control portion of the conditioner chamber and may be nested, such as having additional length configured therein. An exchange conduit may be nested by having a serpentine configuration, a coiled configuration, a pleated configuration and a back and forth configuration. When a separator is configured on the exchange conduit, this nested configuration greatly increase the surface area for moisture transfer to the humidity control chamber.

An exemplary environment control system may reduce humidity levels in the humidity control chamber through one or more dehumidification devices, as described herein. A desiccant may be configured to absorb moisture in the humidity control chamber and may be configured in a dehumidification loop, a conduit with an inlet and outlet coupled with the humidity control chamber. A fan or other air moving device may be used to force a flow of gas from the humidity control chamber through the humidity control chamber. In this way, moisture can be removed actively, by initiating the flow of humidity control chamber gas through the dehumidification loop, versus a passive dehumidification, wherein a desiccant is simply within the humidity control chamber. Any suitable desiccant may be used including silica gel and the like. In addition, a desiccant or desiccator may comprise a heater to drive off absorbed moisture and a set of valves may allow this expelled absorbed moisture to be expelled from the system, thereby rejuvenating the desiccant.

An exemplary environment control system may reduce humidity levels in the humidity control chamber through a condenser. Again, a condenser may be configured within the humidity control chamber or within a dehumidification loop of the humidity control chamber. In addition, a condenser may produce condensed liquid water that can be expelled from the system through a valve or may be provided to a water chamber that is in fluid communication with the anode of the oxygen depletion electrolyzer cell. The anode on the oxygen depletion electrolyzer cell reacts water to from oxygen and protons.

An exemplary environment control system may reduce humidity levels in the humidity control chamber through a separator, such as an ionomer membrane separator, as described herein. The separator may be configured between the humidity control chamber and the outside environment and may transfer moisture from the humidity control chamber to the outside environment when the humidity level within the humidity control chamber is greater than the humidity level in the outside ambient environment.

An exemplary environment control system may reduce humidity levels in the humidity control chamber through a humidity control electrolyzer cell having an anode in fluid communication with the interior volume of the humidity control chamber and a cathode exposed to the outside ambient environment. Water or humidity within the humidity control chamber will react on the anode to form oxygen and protons. The protons are transferred across or through the ionomer membrane and react with oxygen on the cathode to reform water. In addition, water molecules are drug along with the flow of protons from the anode to the cathode. A control system may monitor the humidity level within the humidity control chamber, the oxygen control chamber and/or the enclosure and then control the voltage potential across the anode and cathode of the dehumidification electrolyzer cell of the humidity control chamber.

An exemplary environment control system may comprise a fuel loop, or a conduit that directs gas from the humidity control chamber to the anode side of the oxygen depletion electrolyzer cell and then back to the humidity control chamber. A fuel loop reduces humidity in the humidity control chamber by reaction of water in the fuel loop on the anode of an oxygen depletion electrolyzer cell and may be considered a dehumidification device, as used herein. A fan and one of more valves may be used to provide a flow of gas from the humidity control chamber through the fuel loop and the anode on the oxygen depletion electrolyzer cell may also receive gas or air from the ambient environment outside of the conditioner chamber.

A control system of an exemplary environment control system may comprise one or more sensors, such as an oxygen, humidity, and/or temperature sensor that are configured in the conditioner chamber, the oxygen control chamber, the humidity control chamber and/or the enclosure or conduits to and from the enclosure. The control system may receive input from these sensors and may then control the power level, voltage potential and/or current to the electrolyzer cells to adjust the humidity and/or oxygen levels as required. A user input feature may be used to set an oxygen and/or humidity level and/or limits for the system, such as for the enclosure and the control system, utilizing a processor or micro-processor may then control fans, valves, the power supply to the electrolyzer cells and the like to maintain the user input levels or set points. In addition, data may be collected by the control system and transferred to a secondary location. For example, a removable memory device, such as a thumb drive may be attached to the environment control system to collect data including sensed values of temperature, humidity levels, and oxygen concentration, as well as voltages applied to the electrolyzer cell or cells and the like. The thumb drive could be removed for download on a secondary electronic device or computer. In still another embodiment, an exemplary environment control system comprises a wireless signal transmitter for transmitting the data wirelessly to a secondary location, such as a computer or server. An exemplary environment control system may comprise a wireless signal receiver for receiving set point values for temperature, humidity and/or oxygen concentration and may receive commands including voltage potential inputs for an electrolyzer.

Any number of filters and/or valves may be used to control gas or air flow into or around the environment control system. Fibers may be configured to the conditioner chamber to prevent contaminates from poisoning the electrolyzer cells. Filters may be configured on inlet and outlets to the enclosure. In addition, desiccators may be configured on air or gas inlets to the conditioner chamber, the oxygen control and/or humidity control chambers.

In one embodiment, a fan is configured to produce a flow of process air onto an electrode of an electrolyzer. In an exemplary embodiment, an MEA fan blows onto an electrode, wherein the flow of air is substantially perpendicular, within about 30 degrees of perpendicular, or within about 20 degrees or more preferably within about 10 degrees of perpendicular to the plane of the electrode. It has been found that this greatly increase the performance of the electrolyzer. A fan blowing process air directly onto the anode of an electrolyzer cell has been shown to increase the performance by more than 200 percent. This force air flow onto the anode may remove boundary layers that can reduce reaction rates.

There are many different applications wherein the control oxygen concentration and/or relative humidity levels, RH are required or desired. Many enclosures are configured to control these environmental parameters including, but not limited to, safes or enclosures for valuable items that may be damage by prolonged exposure to high humidity, such as documents, artifacts, jewels, jewelry, weapons, guns, knives, currency and the like. In addition, there are applications where a flow of air having a controlled level of oxygen and/or humidity are desired, such as a Positive Airway Pressure, PAP, device, a respirator, an oxygen respirator and the like. A PAP device provides a pressurized flow of air to a person to aid in effective breathing while sleeping. An environment control system, as described herein, may provide additional humidity and/or oxygen to the flow of air in a PAP device. In addition, there are articles, such as produce, that may be located in an enclosure wherein the control of oxygen level is desired or beneficial. A reduced oxygen level in a refrigerator compartment for produce may prevent the produce from spoiling or going bad. In addition, some enclosures may have a controlled and reduced level of oxygen to kill organisms.

An object of the present invention is to provide independent control of oxygen concentration and humidity level within an enclosure utilizing at least one electrolyzer cell. An exemplary object of this invention is to provide oxygen depletion without an increase in relative humidity to an enclosure or a decrease humidity level of the enclosure. Another exemplary object of this invention is to provide an increased oxygen and humidity level to an enclosure or air flow.

The present invention relates to electrolyzer technology with advanced preserving capabilities for valuables, artifacts, or food items. An exemplary electrolyzer cell is a polymer electrolyte membrane with catalyst and current collectors on both sides with a housing. An electrolyzer cell is typically used while in contact with liquid water to generate oxygen on the anode and hydrogen on the cathode. When used in the open air with no available liquid water, they rely on the available water vapor or humidity in the air.

Oxygen reduction is very desirable to prevent oxidation, to kill germs and bug infestations, preserve food, valuable artifacts and to prevent a fire from originating inside the enclosure. Separately, controlling the humidity is just as important. There are disadvantages to running an electrolyzer cell without independent control of the humidity and oxygen levels. One is that you will likely reach 100% RH in an enclosure before removing all of the oxygen. The other is the lack of precise independent control over either of the conditions. The ideal humidity and oxygen level varies depending on what is being preserved inside the enclosure. One way to achieve precise control is to remove moisture separately with another form of dehumidification or to use an electrolyzer cell in reverse while sealing it off from the enclosure. The seal could consist of a window with a membrane that allows moisture to pass through but not gases, including oxygen. This type of independent control of humidity and oxygen removal requires a way to measure the contents of the enclosure. You also need to be able to independently control the humidifying and dehumidifying system with electronics. The integrity of the seal and the conditions outside the enclosure play a role in the efficiency.

An enclosure, as described herein, includes but is not limited to humidors, refrigerator or freezer sub-compartments, museum displays, gun storage, musical instrument storage, paper storage, and storage of a host of moisture sensitive products such as fossils, ancient artifacts, stamps, bonds, etc. as well as shipping containers. An exemplary control system may be sized to meet the demands of the enclosure. A larger enclosure will require a larger oxygen depletion electrolyzer cell area than a smaller enclosure. An enclosure may be on the order of 0.1 $m^3$ or more, 0.5 $m^3$ or more, 1 $m^3$ or more. 5 $m^3$ or more, 12 $m^3$ or more or no more than about 12 $m^3$ or no more than about 5 $m^3$, no more than 3 $m^3$ and any range between and including the volumes provided.

An exemplary environment control system, may comprise a remote monitor for an enclosure, and may comprise wireless monitoring of the enclosure conditions including humidity level and oxygen concentration or level. The enclosure environmental conditions may be sent to a remote electronic device, such as a mobile telephone, tablet computer or computer. A user may change the desired set points of humidity, temperature and oxygen level of the enclosure. Wireless transmission may also allow a remote electronic device to record the enclosure parameters, temperature, humidity and oxygen level. In addition, a user may receive an alert if there are significant changes in the enclosure environment parameters or if one of the parameters fall moves outside of a threshold value for one of the set points.

There is recognition that in some cases reactant gases must be inside the enclosure. The enclosure may not always be in a hermetically sealed system, i.e. some leakage in and out of the enclosure is air option. In addition, the system can be controlled with a sensor inside the device, in others the system is simply switched on and off for a limited duration.

An exemplary control system comprises an oxygen and humidity control system that can be used in combination with other systems. For example, it has been found that using Spanish cedar with a humidity control device provides humidity buffering. Also, it has been found that using a silica gel in combination with a humidity control device also provides humidity buffering. And there are some advantages because if electricity is switched off, or if for some reason the system under or over humidifies—the buffer can compensate. A silica gel or other hygroscopic material may be placed within an enclosure to provide this moisture buffering. Some hygroscopic materials have a humidity level range wherein the absorb or release moisture when the RH goes above the range or drops below the range, respectively.

Utilizing electrolyzer technology in a cell to move moisture while relying on ambient air conditions can be challenging. The environment providing the moisture can be dry reducing the power output of the cell in either direction. There is also a reduction in performance when this sort of device is used in a cold environment like inside a refrigerator. Therefore, it is of the utmost importance to optimize the cell's electrical contact characteristics with the catalyst. It is also an advantage to heat the cell when in cold environments. In addition, there is a significant advantage to adding air flow on the anode side of the cell in a unique way.

An important application of this technology is for use in medical devices such as CPAP's. Positive airway pressure (PAP) is a mode of respiratory ventilation used primarily in the treatment of sleep apnea. PAP ventilation is also commonly used for those who are critically ill in hospital with respiratory failure, and in newborn infants (neonates). In these patients, PAP ventilation can prevent the need for tracheal intubation, or allow earlier extubating. Sometimes patients with neuromuscular diseases use this variety of ventilation as well. CPAP is an acronym for "continuous positive airway pressure".

A continuous positive airway pressure (CPAP) machine was initially used mainly by patients for the treatment of sleep apnea at home, but now is in widespread use across intensive care units as a form of ventilation. Obstructive sleep apnea occurs when the upper airway becomes narrow as the muscles relax naturally during sleep. This reduces oxygen in the blood and causes arousal from sleep. The CPAP machine stops this phenomenon by delivering a stream of compressed air via a hose to a nasal pillow, nose mask, full-face mask, or hybrid, splinting the airway (keeping it open under air pressure) so that unobstructed breathing becomes possible, therefore reducing and/or preventing apneas and hypopneas. It is important to understand, however, that it is the air pressure, and not the movement of the air, that prevents the apneas. When the machine is turned on, but prior to the mask being placed on the head, a flow of air comes through the mask. After the mask is placed on the head, it is sealed to the face and the air stops flowing. At this point, it is only the air pressure that accomplishes the desired result. This has the additional benefit of reducing or eliminating the extremely loud snoring that sometimes accompanies sleep apnea.

The CPAP machine blows air at a prescribed pressure (also called the titrated pressure). The necessary pressure is usually determined by a sleep physician after review of a study supervised by a sleep technician during an overnight study (polysomnography) at a sleep laboratory. The titrated pressure is the pressure of air at which most (if not all) apneas and hypopneas have been prevented, and it is usually measured in centimeters of water (cmH2O). The pressure required by most patients with sleep apnea ranges between 6 and 14 cmH2O. A typical CPAP machine can deliver pressures between 4 and 20 cmH2O. More specialized units can deliver pressures up to 25 or 30 cmH2O.

CPAP treatment can be highly effective in treatment of obstructive sleep apnea. For some patients, the improvement in the quality of sleep and quality of life due to CPAP treatment will be noticed after a single night's use. Often, the patient's sleep partner also benefits from markedly improved sleep quality, due to the amelioration of the patient's loud snoring. Given that sleep apnea is a chronic health issue which commonly doesn't go away, ongoing care is usually needed to maintain CPAP therapy.

An automatic positive airway pressure device, APAP, AutoPAP, AutoCPAP, automatically titrates, or tunes, the amount of pressure delivered to the patient to the minimum required to maintain an unobstructed airway on a breath-by-breath basis by measuring the resistance in the patient's breathing, thereby giving the patient the precise pressure required at a given moment and avoiding the compromise of fixed pressure.

Bi-level positive airway pressure devices, BPAP, and variable positive airway pressure devices, VPAP, provide two levels of pressure: inspiratory positive airway pressure, IPAP, and a lower expiratory positive airway pressure, EPAP, for easier exhalation. Some people use the term BPAP to parallel the terms APAP and CPAP. Often BPAP is incorrectly referred to as "BiPAP". However, BiPAP is the name of a portable ventilator manufactured by Respironics Corporation; it is just one of many ventilators that can deliver BPAP.

Expiratory positive airway pressure (Nasal EPAP) devices are used to treat primary snoring and obstructive sleep apnea (OSA). The device used to treat primary snoring is an over-the-counter version while the device for OSA is stronger and requires a prescription. OSA is a serious condition with significant consequences when left untreated. Snoring, while not as significant as OSA, still disturbs sleep and can cause potential harm, over time, to the sufferer. Devices in this category are relatively new and limited in number. Using the power of an individual's own breath, these devices don't require electricity to function. Typically, they fit over an individual's nostrils and contain a small valve which opens as you breathe in and closes as you breathe out, creating gentle pressure to naturally keep the airway open and relieve snoring.

There are many optional features generally increase the likelihood of PAP tolerance and compliance. One important feature is the use of a humidifier. Humidifiers add moisture to low humidity air which can increase patient comfort by eliminating the dryness of the compressed air. The temperature can usually be adjusted or turned off to act as a passive humidifier if desired. In general, a heated humidifier is either integrated into the unit or has a separate power source.

Mask liners: Cloth-based mask liners may be used to prevent excess air leakage and to reduce skin irritation and dermatitis.

An exemplary environment control system may be integrated with any of the PAP devices described herein and can increase oxygen as well as control humidity levels. In addition, an exemplary environment control device may be solid state and quiet, an important feature for a device utilized during sleep.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
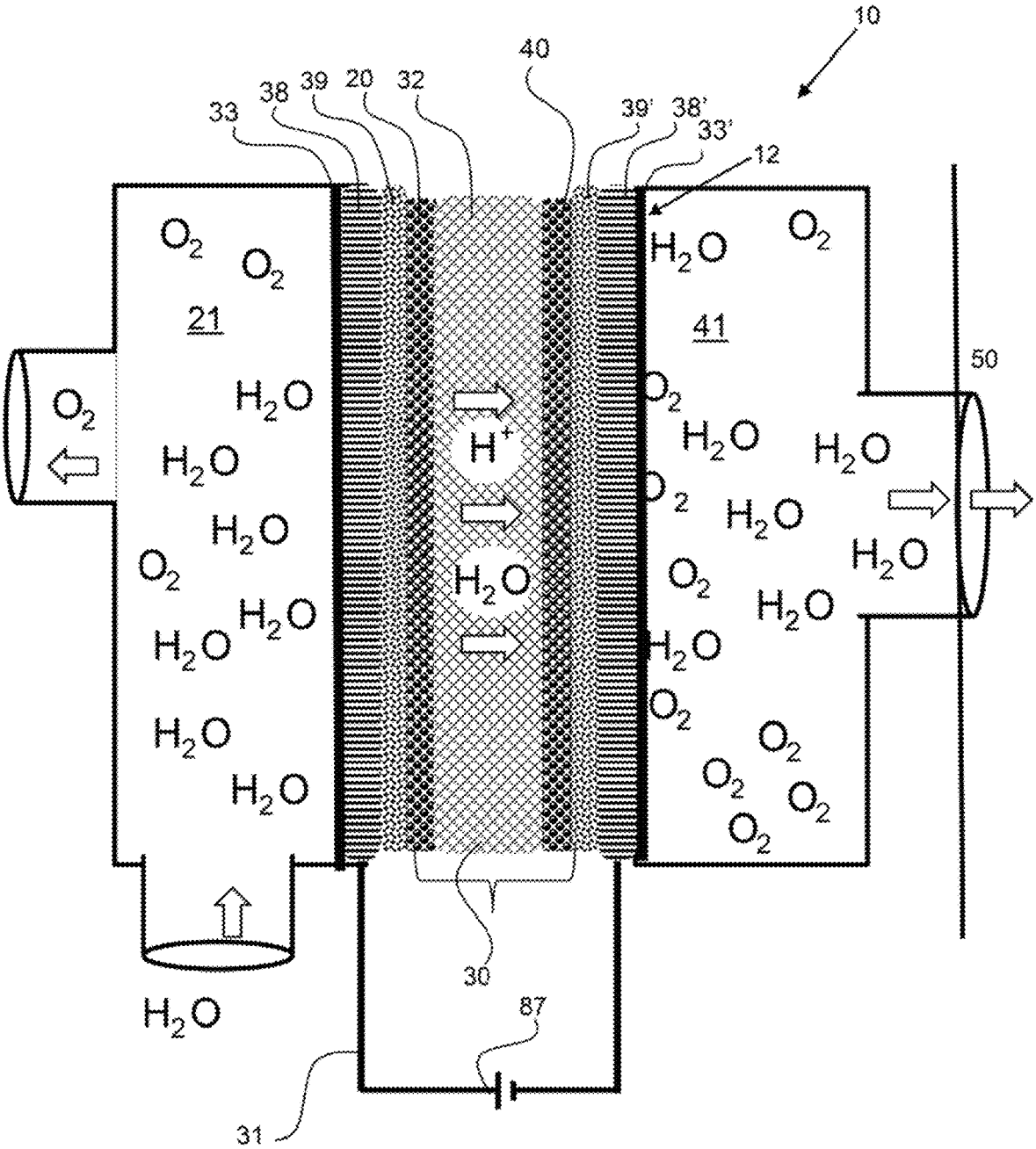
FIG. 1 shows an exemplary electrochemical cell comprising a membrane electrode assembly connected to a circuit for delivery of power from a power source, wherein electrolysis of water on the anode side produces protons that are transported across the ion conducting membrane to the cathode side.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

FIG. 1 shows an exemplary environment control system 10 that utilizes an electrochemical cell 12 comprising a membrane electrode assembly 30 connected to a circuit 31 for delivery of power from a power source 87. The anode 20 of the MEA reacts with water to produce oxygen and protons. The protons $H^+$ pass through proton conducting layer such as an ionomer, an example of an ion exchange medium 32, to the cathode 40. Water is pulled through the ionomer along with the protons. At the cathode, the protons react with oxygen and produce water, thereby reducing the oxygen at the cathode and increasing water. The cathode is in fluid communication with the enclosure 50 and therefore reduces the oxygen concentration and increases the moisture or RH of the enclosure. The electrochemical cell also includes a gas diffusion layer 39, a flow field 38 and a current collector 33, configured on both the anode and cathode.

Figure 2:
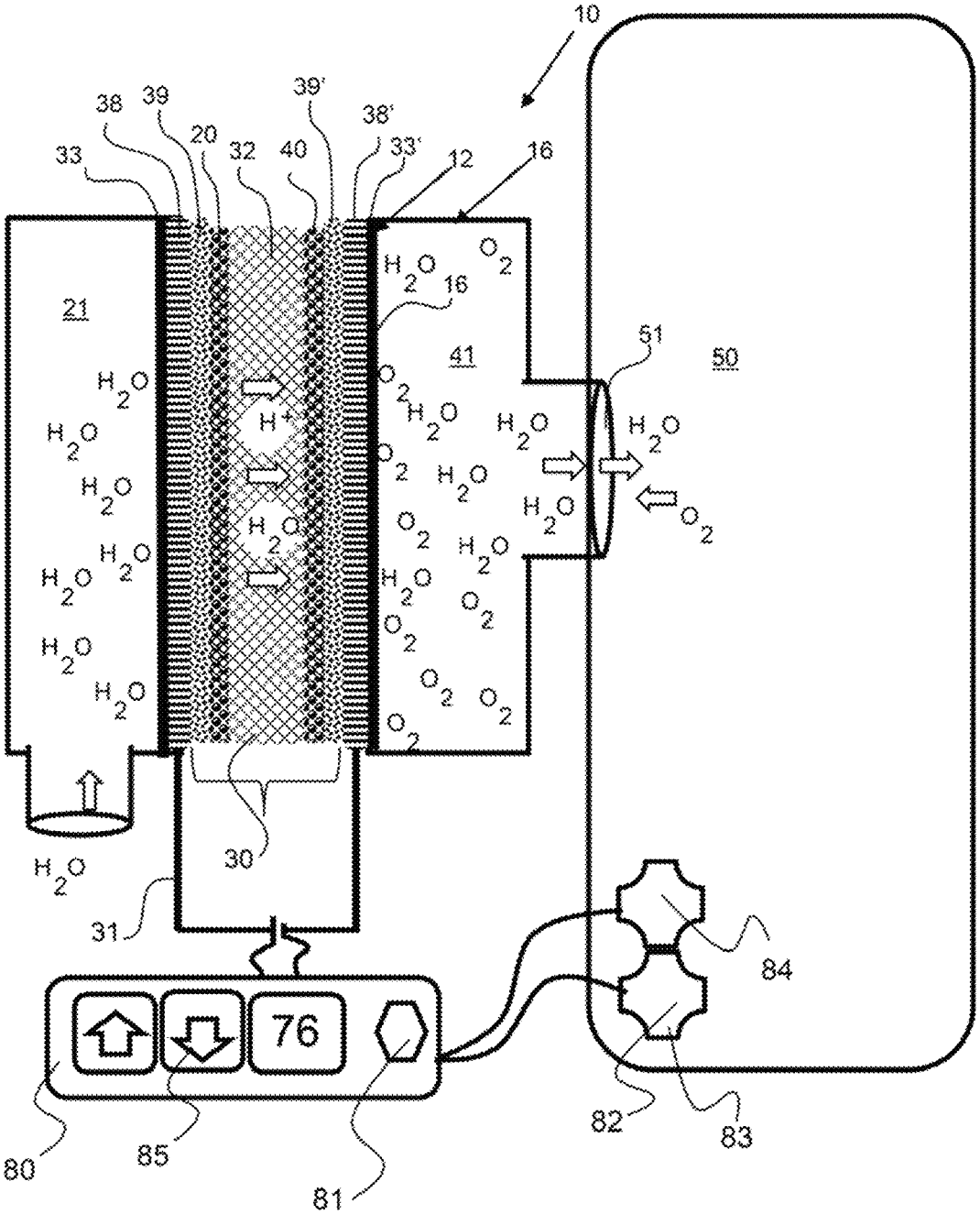
FIG. 2 shows an exemplary environment control system comprising an electrochemical cell coupled with an enclosure.

As shown in FIG. 2, an exemplary electrochemical cell 12 utilizes a, membrane electrode assembly, MEA 30, connected to a circuit 31 for power. As shown, this is an oxygen control electrolyzer cell 16 that is reducing oxygen concentration in the enclosure 50. An electrical potential is created across the anode and cathode to initiate the electrolysis of water on the anode 20, that produces oxygen and protons that are transported across the ion conducting media 32 or membrane, or ionomer, to the cathode 40. A chamber is configured on the anode side 21 for receiving incoming air and water moisture and a chamber or space on the cathode side 41 is in fluid communication with an enclosure 50, such as through one or more openings 51 into the enclosure. On the cathode, the protons are reacted with oxygen to produce water. Oxygen is depleted on the cathode side and water is produced. The protons also drag water across the ionomer from the anode side to the cathode side. On the anode side, oxygen is produce and water is consumed in electrolysis reaction that produces oxygen and protons. The membrane electrode assembly is coupled between two electrical current collectors 33, or electrically conductive layers, that provide the electrical power to the MEA. An electrical conductor plate, may be a screen or perforated metal and may be the gas diffusion media and/or a flow field. A flow field 38 may have a plurality of channels for distributing gasses to the surface of the MA or gas diffusion media. A gas diffusion media 39 may further distribute gas to the anode and cathode. A sensor 82, such as a humidity sensor 83 and/or oxygen sensor 84, may be coupled with a control system 80 for maintaining the humidity and/or oxygen level within the enclosure to a desired level. A user input 85 may be used to set a desired level or range of humidity and/or oxygen concentration within the enclosure and a micro-processor 81 may control the power supply to the electrochemical cell to keep the oxygen and humidity within the set points by the user. The electrochemical cell may be run in the opposite direction, wherein the anode is in fluid communication with the enclosure and reduces moisture and increase oxygen concentration.

Figure 3:
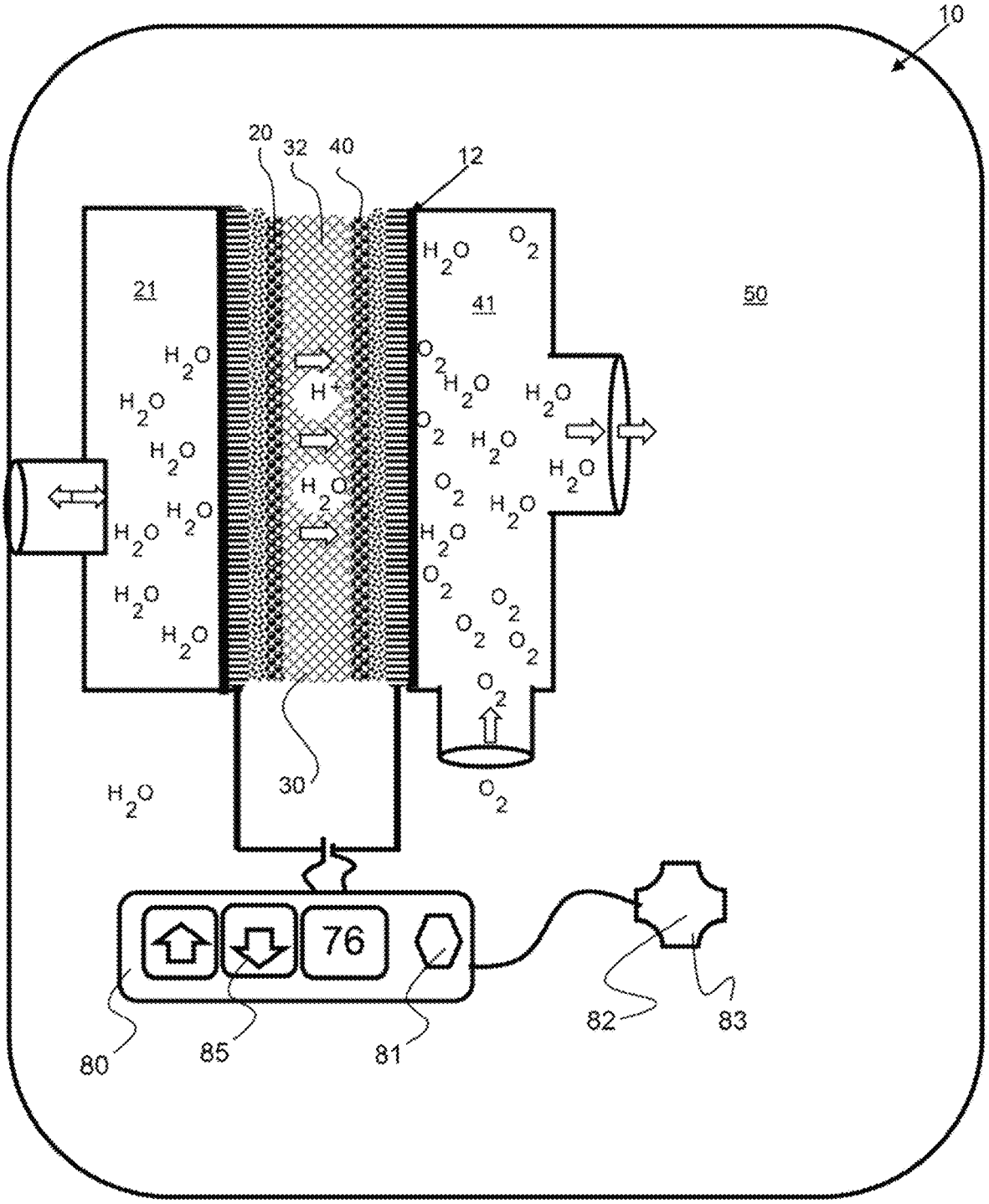
FIG. 3 shows an exemplary environment control system configured at least partially within an enclosure.

As shown in FIG. 3, an exemplary environment control system 10 comprises an electrochemical cell 12 at least partially configured within the enclosure 50. As shown, this is an oxygen control electrolyzer cell 16 that is reducing oxygen concentration in the enclosure 50. In this embodiment, the MEA 30 may be run in a direction to produce moisture within the enclosure or to pump moisture out of the enclosure. An inlet/outlet conduit 25 on the anode side 21 extends out of the enclosure. Again, the electrochemical cell may be run to increase or decrease the humidity and/or oxygen concentration within the enclosure. The cell can be operated to pump water into the enclosure or operated to pump water out of the enclosure by changing the polarity across the anode and cathode. The humidification control system may provide humid air to the enclosure by control of the circuit power to drive the electrolysis of water. A sensor 82, such as a humidity sensor 83, monitors humidity and relays this measured value to the controller system 80. A processor 81 may control the amount of power, voltage and/or current to the MEA to control the amount of humid air provided to the enclosure. A user interface 85, as shown by the up and down arrows may be used to adjust the humidity level within the enclosure. The cathode side of the electrochemical cell is coupled with and enclosure and will reduce the oxygen level, while increasing the humidity level.

Figure 4:
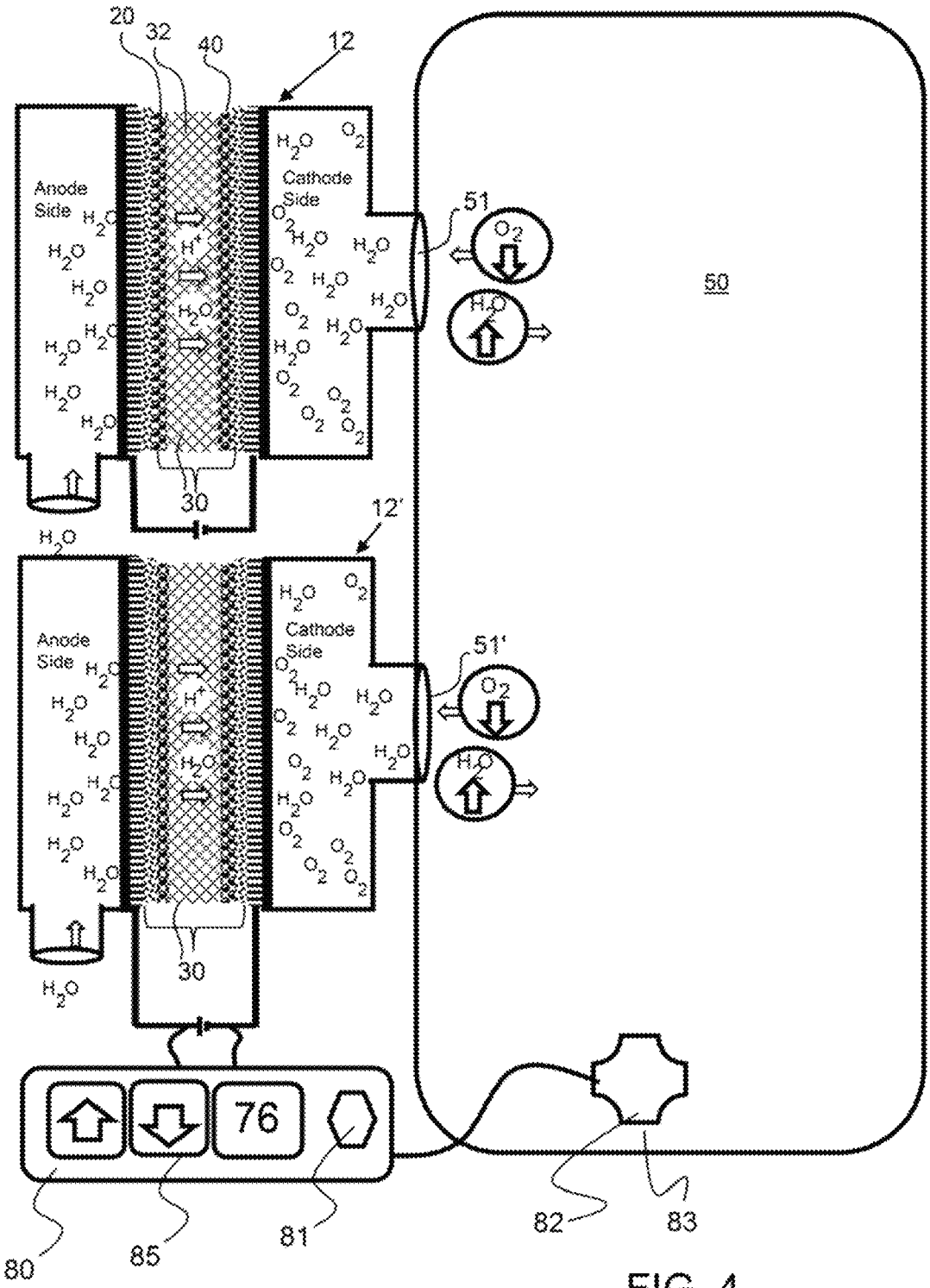
FIG. 4 shows an exemplary environment control system comprising two electrolyzer cells coupled with an enclosure.
Figure 5:
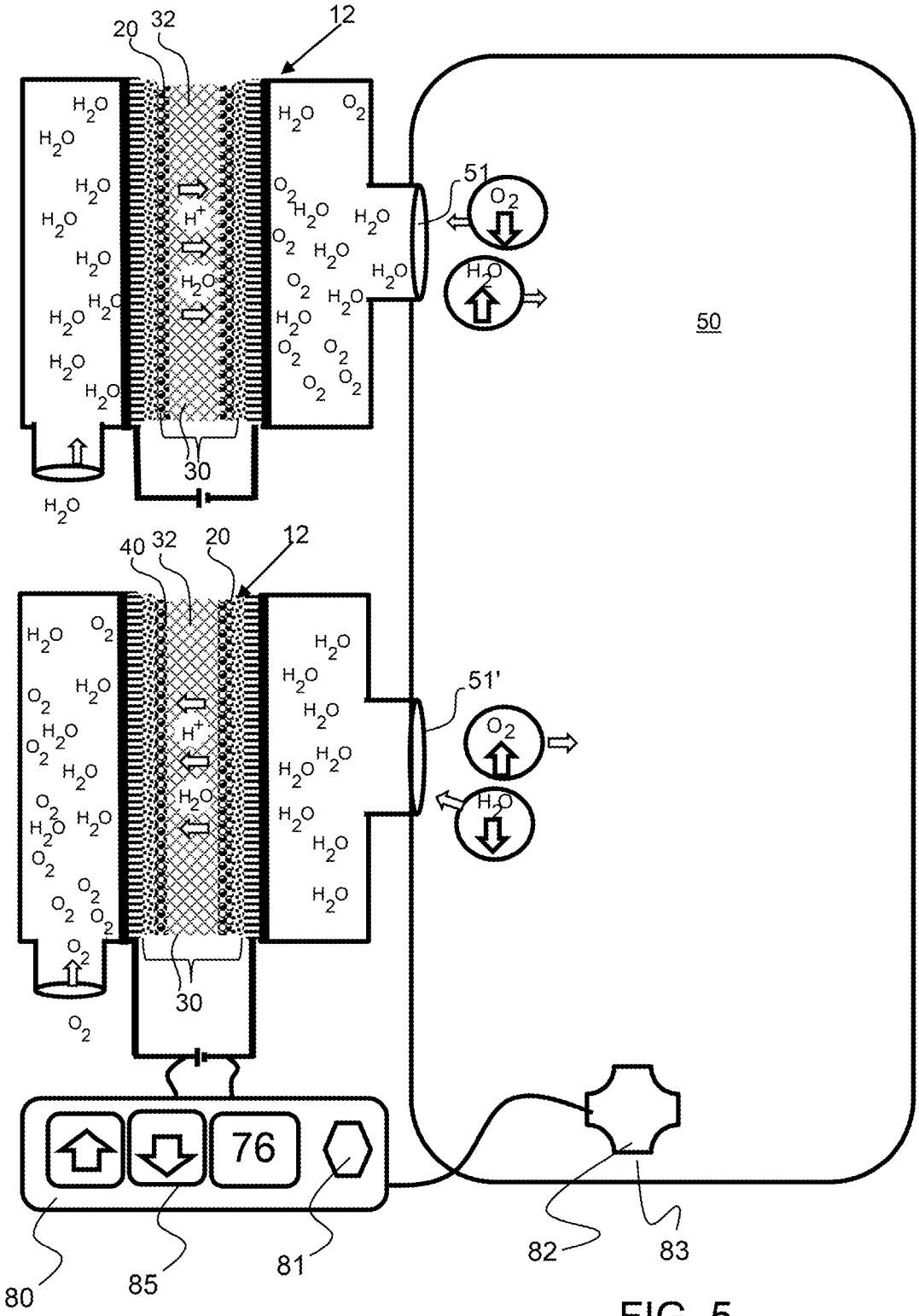
FIG. 5 shows an exemplary environment control system comprising two electrolyzer cells coupled with an enclosure with one of the cells having the anode in fluid communication with the enclosure and the other cell having the cathode in fluid communication with the enclosure.

Referring now to FIGS. 4 and 5, an exemplary environment control system 10 comprises two electrochemical cells 12, 12' in fluid communication with the enclosure 50. The two cells may be operated in the same mode, such as oxygen depletion and humidification mode, as shown in FIG. 4, wherein the cathode is in fluid communication with the enclosure, thereby increase the rate of oxygen reduction within the enclosure and humidity increase within the enclosure. The two cells may also be operated in an oxygen increase and humidity reduction mode, wherein the anode is in fluid communication with the enclosure, thereby increasing the rate of oxygen increase and humidity reduction within the enclosure. Furthermore, the two electrochemical cells, may be operated in opposing modes, as shown in FIG. 5, wherein one electrochemical cell is configured to reduce oxygen concentration within the enclosure and one is configured to increase oxygen within the enclosure. In this opposing operation mode, the two cell may somewhat counteract each other and may be less effective.

Figure 6:
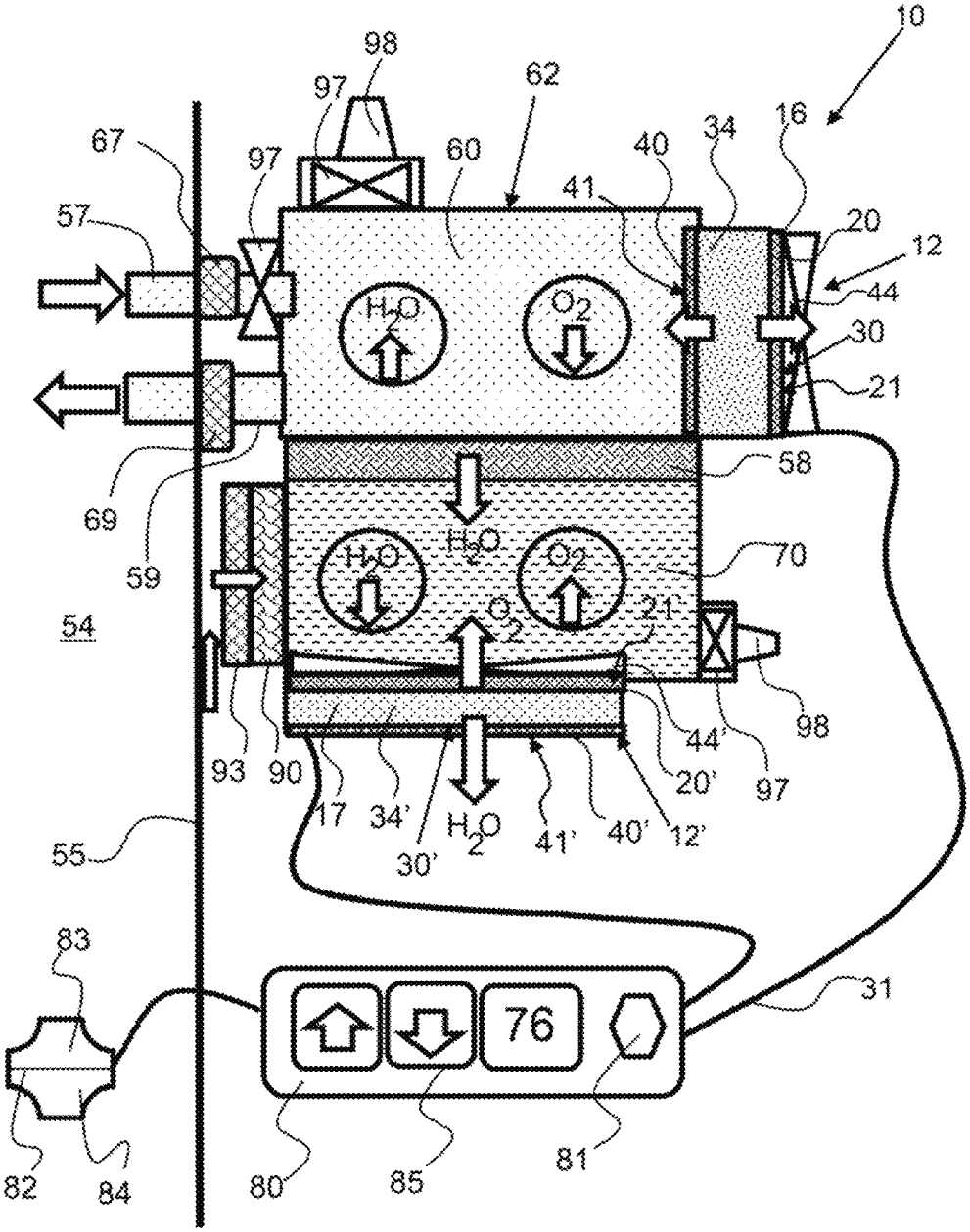
FIG. 6 shows a diagram of an exemplary environment control system having a separator to draw moisture from the oxygen control chamber.
Figure 8:
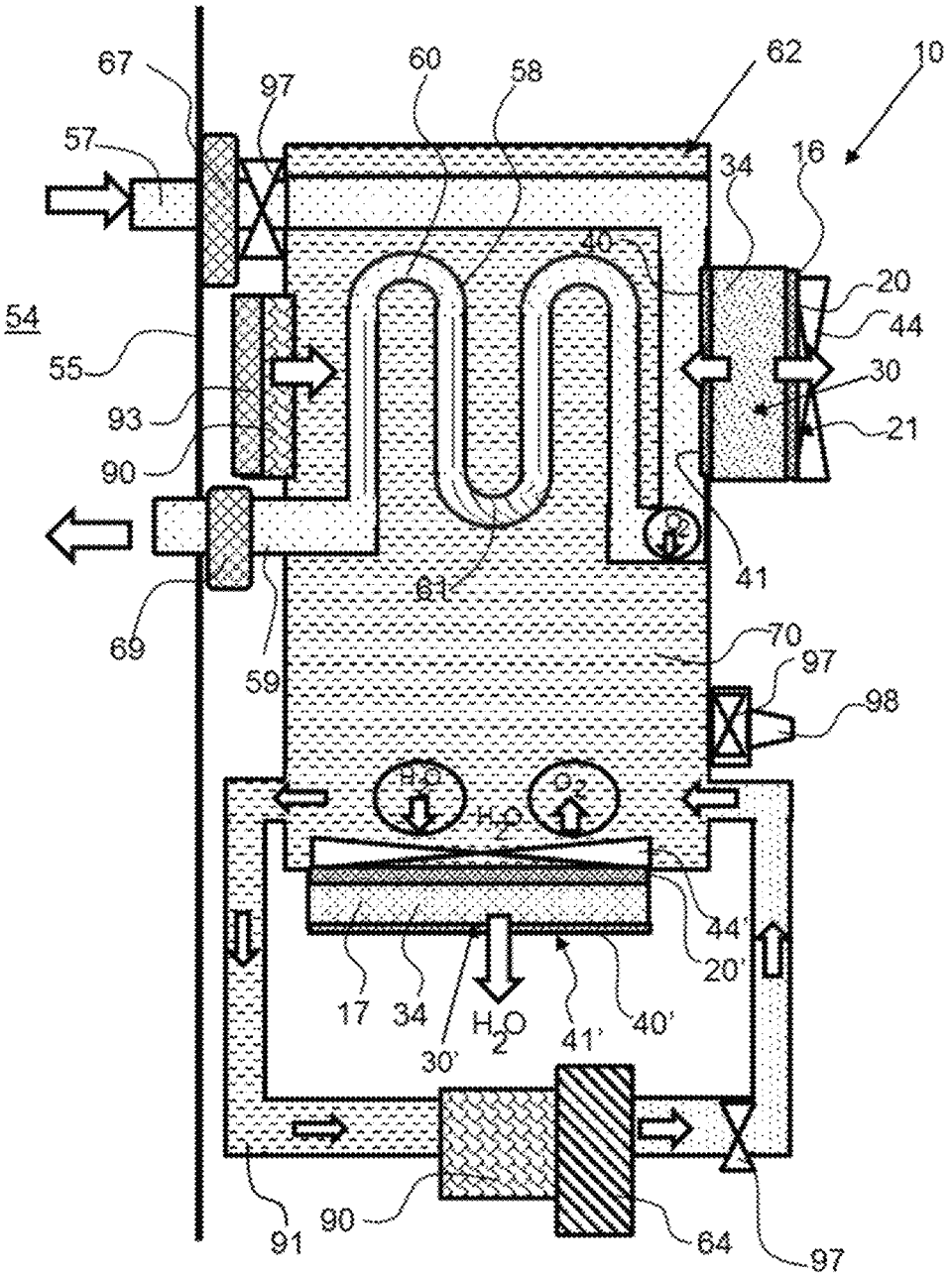
FIG. 8 shows a diagram of an exemplary environment control system having a serpentine exchange conduit through the conditioner chamber to enable effective moisture transfer from the exchange conduit to the conditioner chamber.

As shown in FIG. 6, an exemplary environment control system 10 has two electrochemical cells 12, 12' coupled with a conditioner chamber 62 and a separator 58 configured between the oxygen control chamber 60 and the humidity control chamber 70. An oxygen control electrolyzer cell 16 has the anode cathode 40 in fluid communication with the oxygen control chamber 60 and a humidity control electrolyzer cell 17 has the anode 20' in fluid communication with the humidity control chamber 70. The separator membrane, as described herein, allows moisture to be transferred between the oxygen and humidity control chambers, but limits the transfer of oxygen, since it is essentially air impermeable. Therefore, when there is a differential in humidity levels between the oxygen control chamber 60 and the humidity control chamber 70, humidity will pass through the separator 58. The separator may be an ionomer membrane for example. The humidity control chamber 70 has the anode 20' of the second electrochemical cell 12' in fluid communication to reduce humidity and increase oxygen concentration. This reduces humidity level will cause humidity from the oxygen control chamber 60 to pass through the separator and therefore reduce the humidity level in the oxygen control chamber. In this way, the oxygen control chamber may have a reduces oxygen concentration and a reduce humidity concentration, which is desirable for many types of enclosures. A fan 97 may be configure to control the flow from the oxygen control chamber to the enclosure 50, through the enclosure wall 55. An inlet exchange conduit 57 is configured with a filter 67 and the outlet exchange conduit 59 is also configured with a filter 69. A fan 97 or other air moving device is configured to force flow and exchange between the enclosure and the conditioner chamber 62, and specifically the oxygen control chamber 60. A fan and valve may be configured on the oxygen control chamber 60 or the humidity control chamber 70 to allow exchange with the outside environment. The concentration of humidity and/or oxygen may require an air exchange with the outside air, for example. A desiccant 90 and filter 93 are configured to reduce the humidity concentration in the humidity control chamber and may reduce the moisture from air being drawn into the humidity control chamber or may be configured in a circulation loop of the humidity control chamber, as shown in FIG. 8, for example. A desiccant may be replaced periodically as required by the application. A controller 80 may utilize inputs from sensors 83,84 to control the operation of the environment control system 10.

Figure 7:
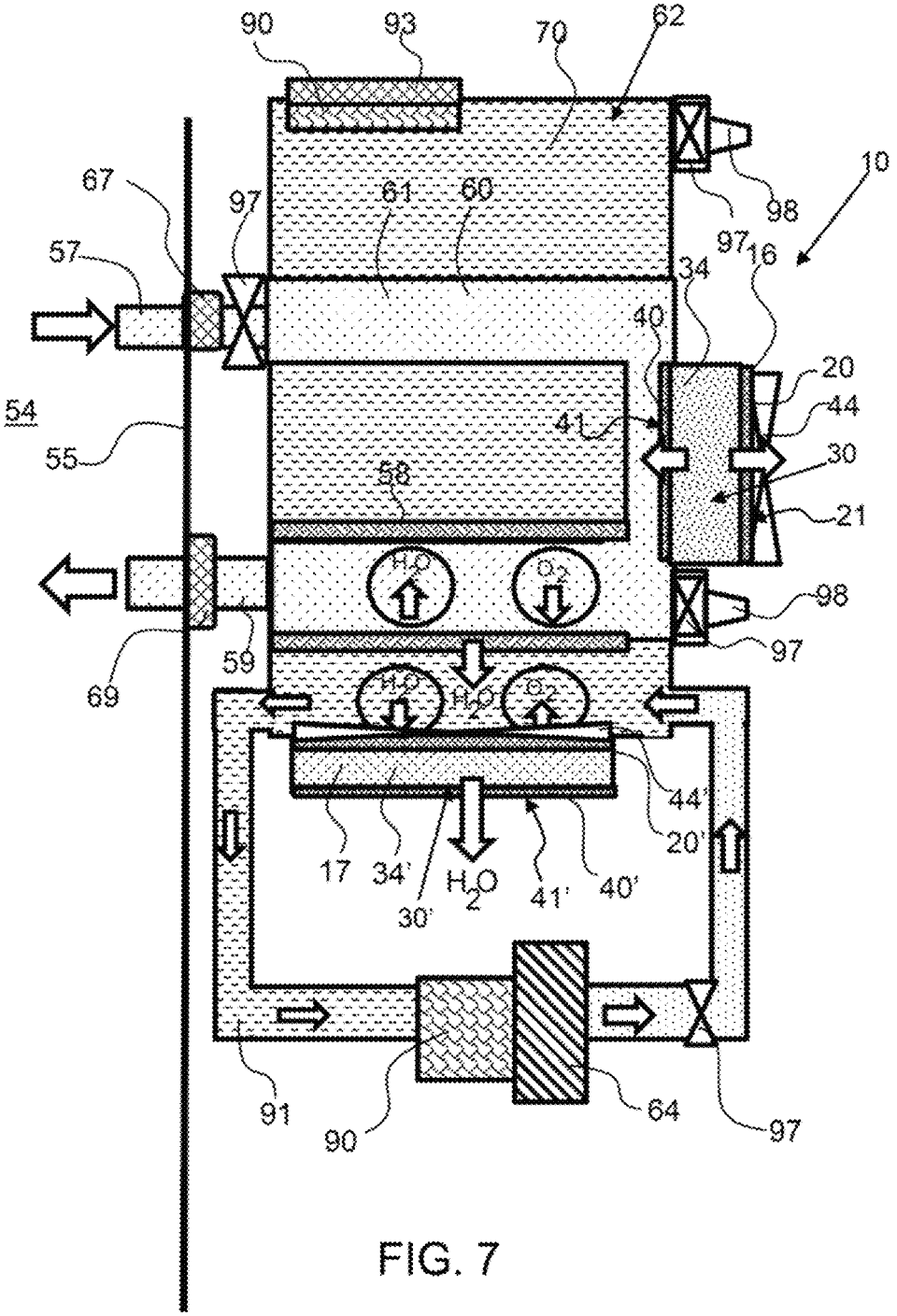
FIG. 7 shows a diagram of an exemplary environment control system having an exchange conduit through the conditioner chamber that exchanges moisture through a separator.

As shown in FIGS. 7 and 8, an exemplary environment control system 10 has an exchange conduit 61 as an oxygen control chamber 60 with an inlet 57 and outlet 59. The exchange conduit 61 extends within the conditioner chamber, wherein at least a portion of the exchange conduit is configured with a separator 58 to allow moisture to pass from the exchange conduit, or oxygen control chamber, into the humidity control chamber 70 portion of the conditioner chamber 62. In this embodiment, more surface area may be provided for the separator. In addition, the humidity control chamber may be configured with a dehumidification loop 91 that circulates gases from the humidity control chamber through a desiccator 90. A fan 97 is configured to move gasses through the dehumidification loop. As shown in FIG. 8, the exchange conduit 61 is serpentine, to provide additional separator 58 exchange surface area. Again, any number of valves 98 and fans 97 may be used to exchange gasses within the chambers with the outside environment, as described herein. A condenser 64 is also shown in the dehumidification loop. A condenser and/or desiccant or desiccator may be configured in the dehumidification loop.

Figure 9:
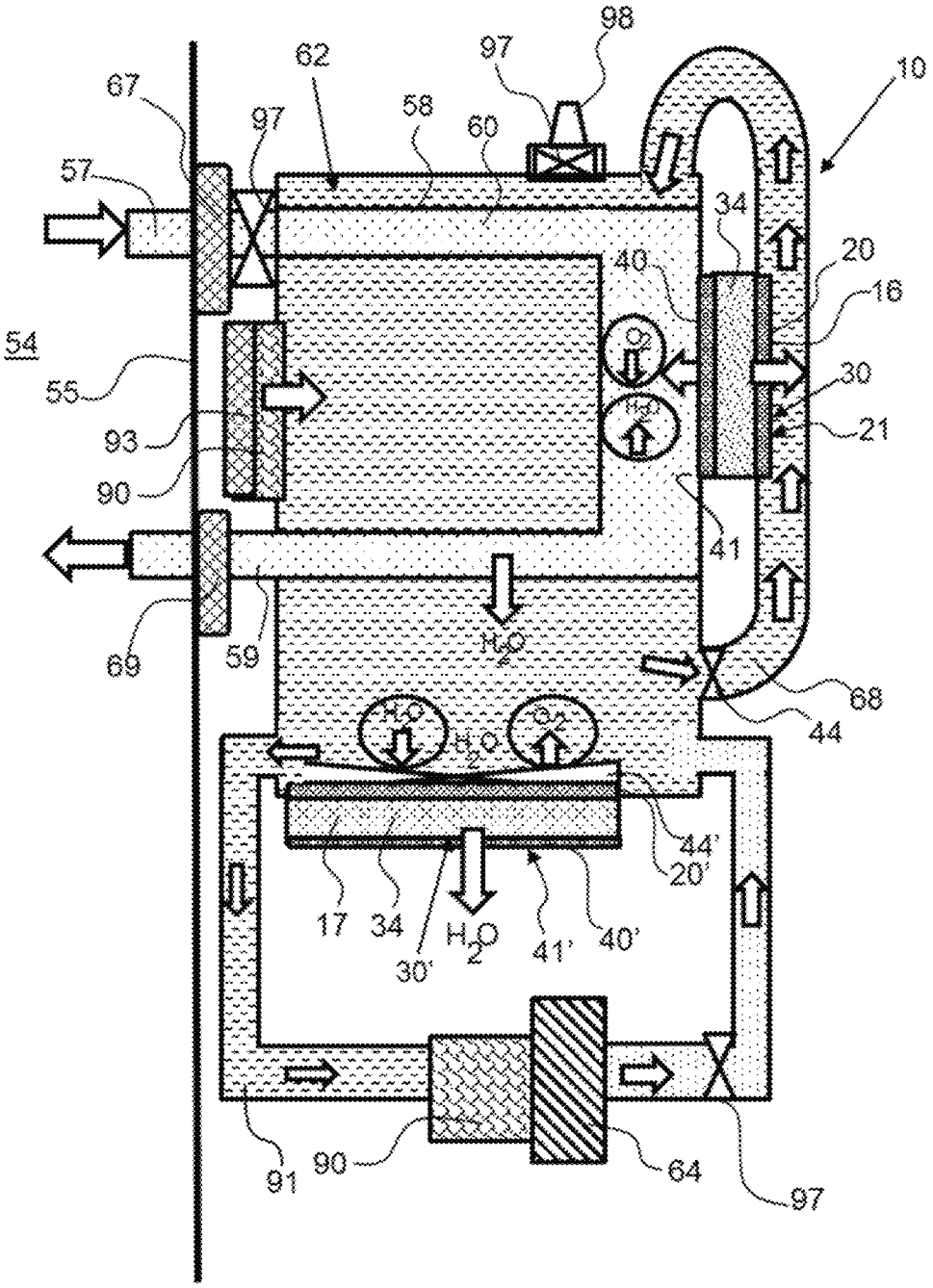
FIG. 9 shows a diagram of an exemplary environment control system having a recirculation loop between the conditioner chamber and the anode side of oxygen depletion electrolyzer cell.

As shown in FIG. 9, a portion of the humidity control chamber 70 gas is fed to the anode side of the electrochemical cell 12, an oxygen control electrolyzer cell 16 operating as an oxygen depletion electrolyzer cell. The oxygen depletion electrolyze cell is configured with the cathode 40 in fluid communication with the oxygen control chamber 60 and the humidity control electrolyzer cell 17, acting as a humidity reduction electrolyzer cell, is configured with the anode 20' in fluid communication with the humidity control chamber 70. The humidity control chamber may comprise moisture that can be consumed by the reaction at the anode of the oxygen depletion electrolyzer cell, wherein water is converted to oxygen and protons. A fuel loop 68 is configured to direct humidity control chamber gas to the anode of the oxygen depletion electrolyzer cell. In this way, the moisture can be reduced in the humidity control chamber 70 while providing the necessary fuel to the anode of the oxygen depletion electrolyzer cell. Again, any number of valves 98 and fans 97 may be used to exchange gasses within the chambers with the outside environment, as described herein. A condenser 64 is also shown in the dehumidification loop. A condenser and/or desiccant or desiccator may be configured in the dehumidification loop.

Figure 10:
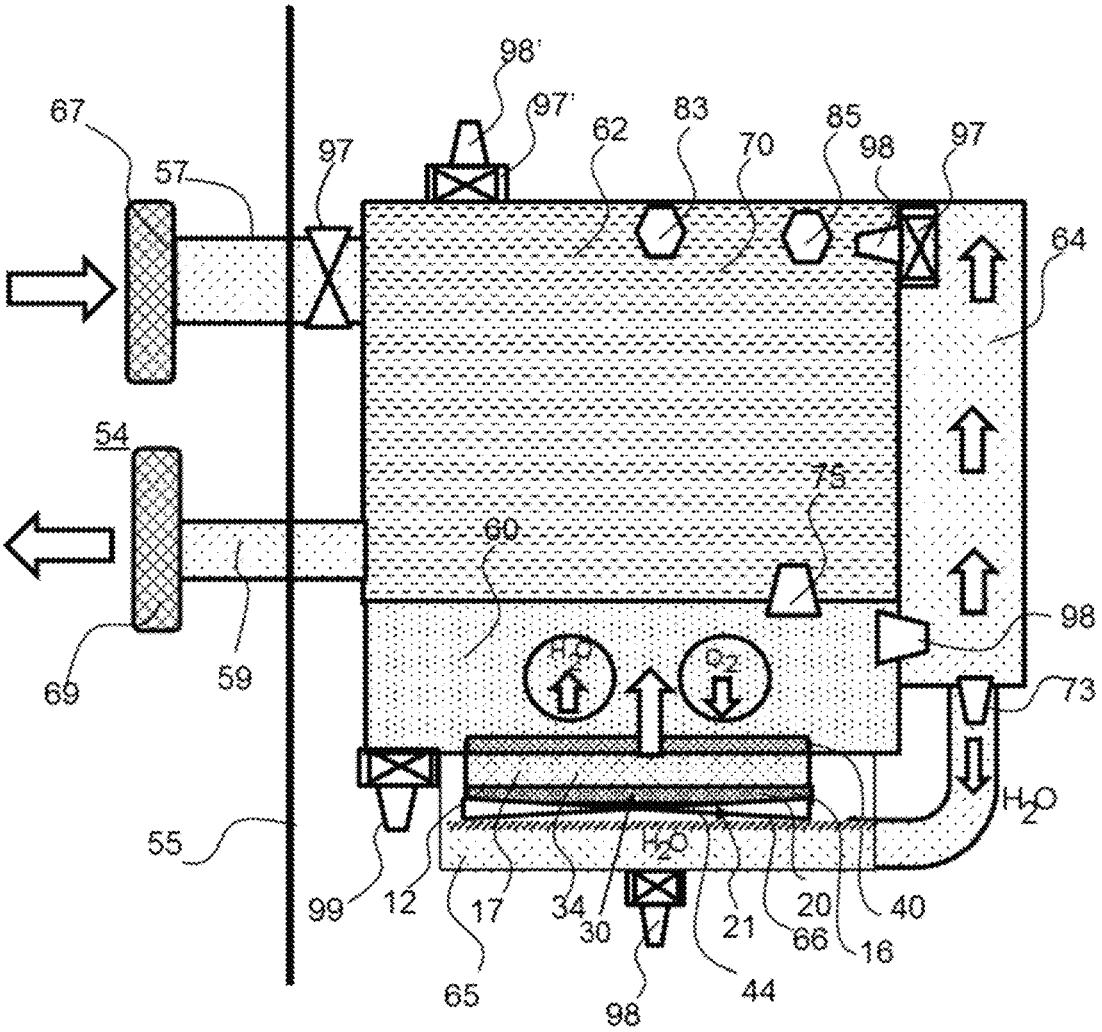
FIG. 10 shows a diagram of an exemplary environment control system having a water chamber and an oxygen bleed valve.

As shown in FIG. 10, an exemplary environment control system 10 has a water chamber 65 with a pervaporation layer 66 between the water chamber and the oxygen control electrolyzer cell. The pervaporation layer may be an ionomer membrane or any other material that allow water vapor to transfer through without any bulk flow of air, as described herein. A condenser 64 is configured condense humidity into liquid water from the conditioner chamber 62. In this embodiment, a single electrochemical cell 12 is utilized to reduce the oxygen concentration in the oxygen control chamber 60 of the conditioner chamber 62, which is in fluid communication with the enclosure 50 through the condenser. The condenser is configured to draw gas from the oxygen control chamber 60. In one embodiment, there is no separator between the oxygen control chamber and the humidity control chamber and the gas fed to the condenser is drawn from the conditioner chamber generally and the electrochemical cell reduces oxygen from this same conditioner cell. However, as shown, the oxygen control chamber is configured with an opening to the condenser, a valve 98 is shown here. The gas in the oxygen control chamber has a reduced oxygen concentration and an increased humidity level, or water content. An oxygen bleed valve 99 may be configured to bleed the gases from the oxygen control chamber or any portion of the conditioner chamber. Gas is drawn into the condenser and the water vapor is condensed and collects in the bottom of the condenser, wherein it can be fed to through a valve 73 to a water chamber 65, or fuel chamber for the oxygen control electrolyzer cell 16 acting as an oxygen depletion electrolyzer cell. This may be a way of providing the water required to the oxygen depletion electrolyzer cell, especially in arid environments. The pervaporation separator 66 keeps any contaminates in the water from fouling or poisoning the catalyst of the anode. A valve may be opened when required to draw in more air to the cathode side of the oxygen reduction electrolyzer cell.

As shown in FIGS. 6 to 10, a MEA air moving device 44 is configured to produce a flow of process air, or forced air onto the anode of the oxygen control electrolyzer cell 16. The forced air may impinge directly onto the anode as shown in FIGS. 6 to 9 or may flow across the MEA, as shown in FIG. 10. As shown in FIGS. 6 to 9 an MEA air moving device 44 is couple with the humidity control electrolyzer cell 17 and configured to produce a flow of process air onto the anode of the humidity control electrolyzer cell. As described herein, the flow of process air onto the anode can greatly improve the performance of the cell.

Figure 11:
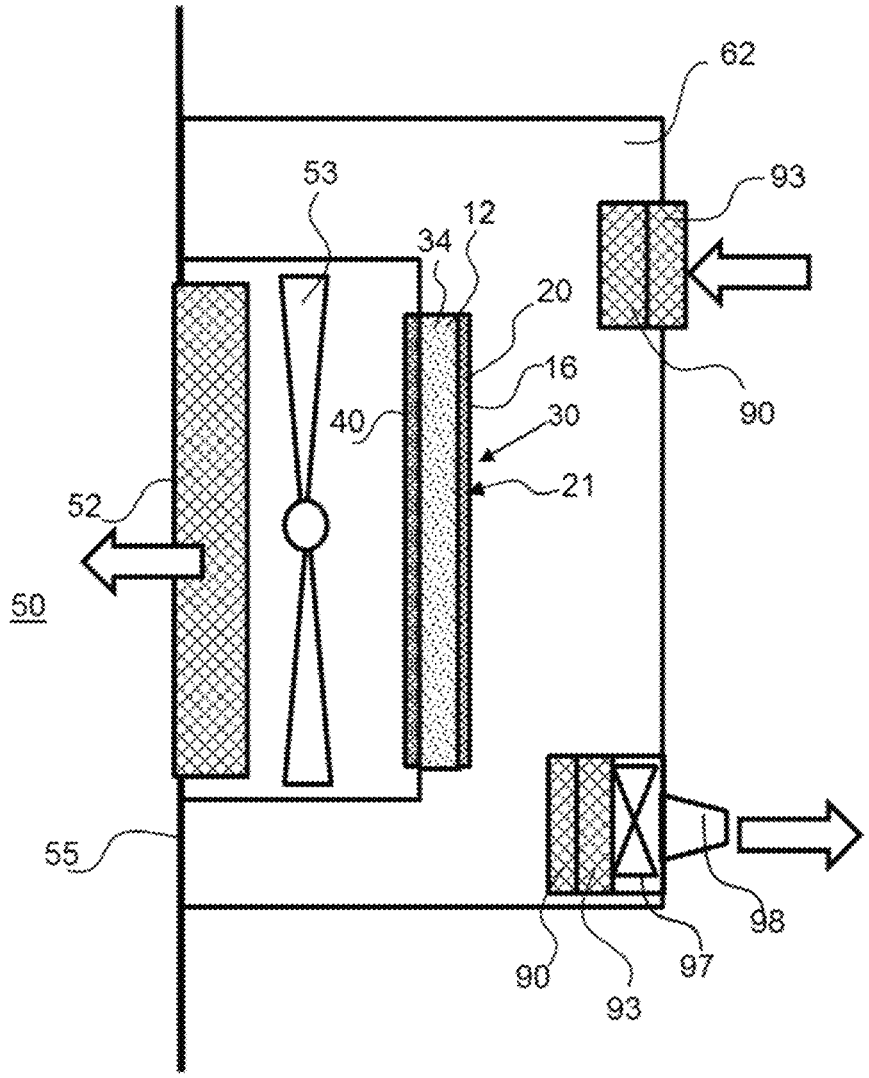
FIG. 11 shows a diagram of an exemplary environment control system having an enclosure filter, a conditioner chamber and inlet and outlet filters to the conditioner chamber.

As shown in FIG. 11, an exemplary environment control system 10 has an enclosure filter 52 to the enclosure 50, and inlet and outlet filters to the conditioner chamber 62. An activated carbon may be used in the enclosure filter to protect the MEA from contaminates inside the enclosure. The conditioner chamber may also comprise inlet and/or outlet filters to protect the MEA from contaminants from the ambient air. This humidification control system has a single electrochemical cell 12, a humidification control electrochemical cell 17 that may be run with the anode or the cathode in fluid communication with the enclosure. Likewise, it may be an Oxygen control electrochemical cell.

Figure 12:
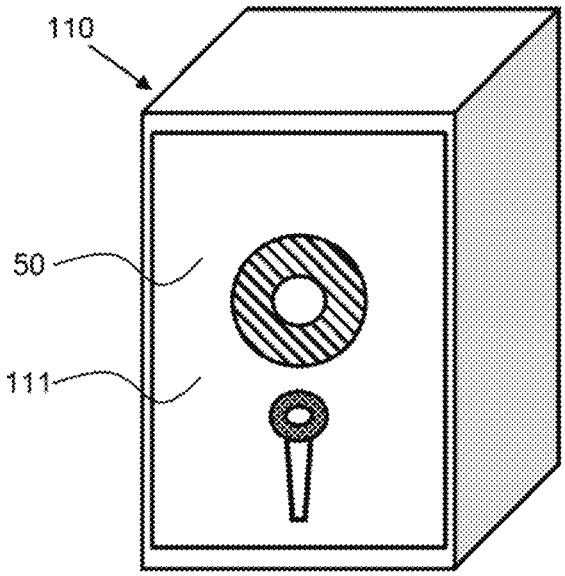
FIG. 12 shows a front view of a safe having a lock on the front door.
Figure 13:
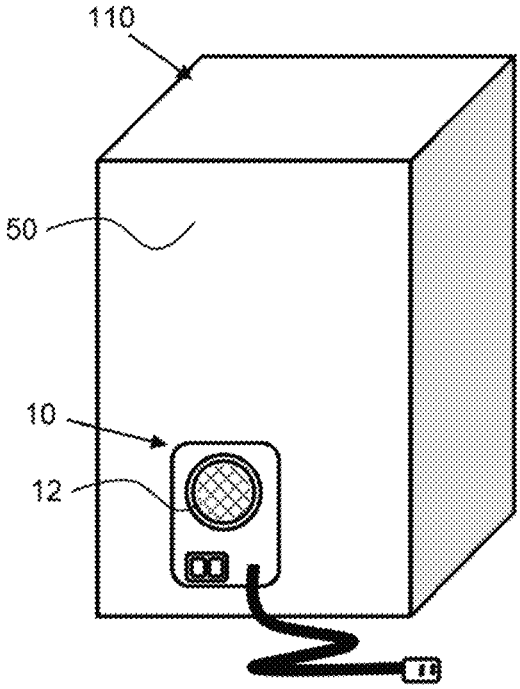
FIG. 13 show a back view of the safe shown in FIG. 12 with an exemplary environment control system coupled to the back.

As shown in FIGS. 12 and 13, an exemplary environment control system 10 is configured to control the environment within a safe 110. The front of the safe, as shown in FIG. 12 has a door 111 to form an enclosure 50. The environment control system 10 is configured on the back side of the safe, as shown in FIG. 13, and may control the level of oxygen and/or humidity within the safe enclosure.

Figure 14:
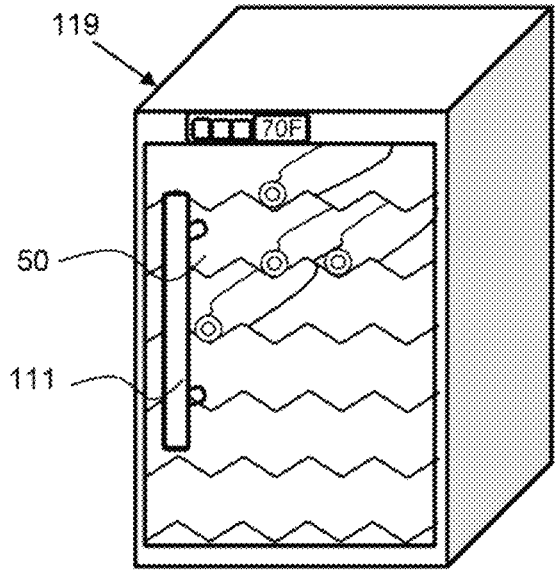
FIG. 14 shows a front view of a wine cooler having a front door to the interior of the enclosure.
Figure 15:
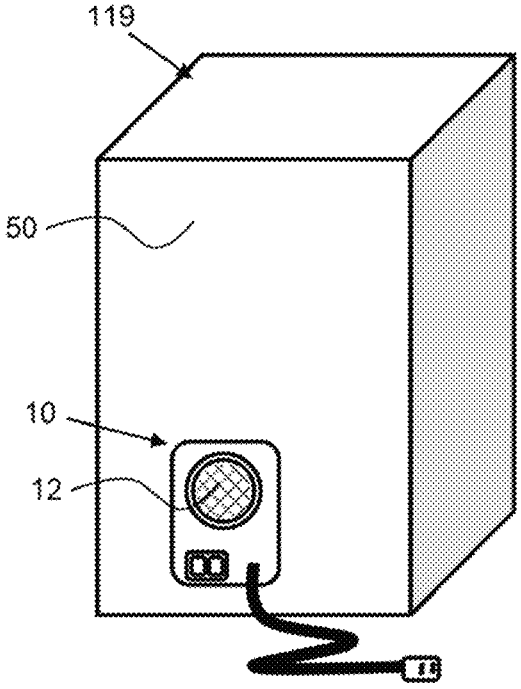
FIG. 15 show a back view of the wine cooler shown in FIG. 14 with an exemplary environment control system coupled to the back.

As shown in FIGS. 14 and 15, an exemplary environment control system 10 is configured to control the environment within a refrigerator 119, in this a wine cooler. The front of the wine cooler, as shown in FIG. 14 has a door 11 to form an enclosure 50. The environment control system 10 is configured on the back side of the wine cooler, as shown in FIG. 15, and may control the level of oxygen and/or humidity within the refrigerator.

Figure 16:
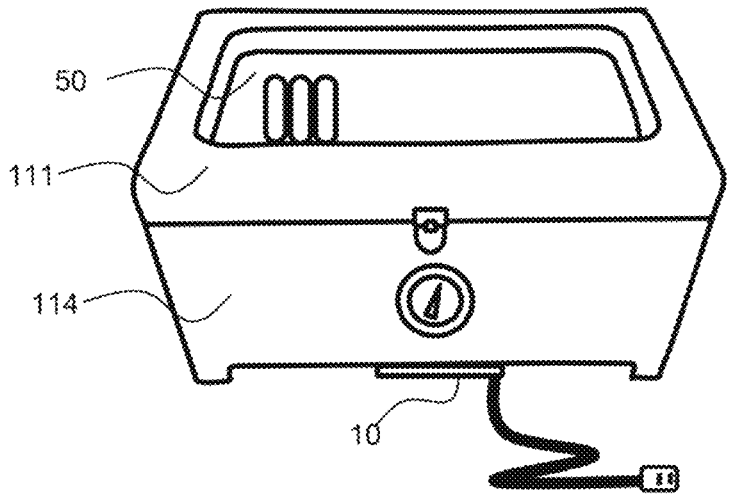
FIG. 16 shows a front perspective view of a humidor having a door to the interior of the enclosure on the top.
Figure 17:
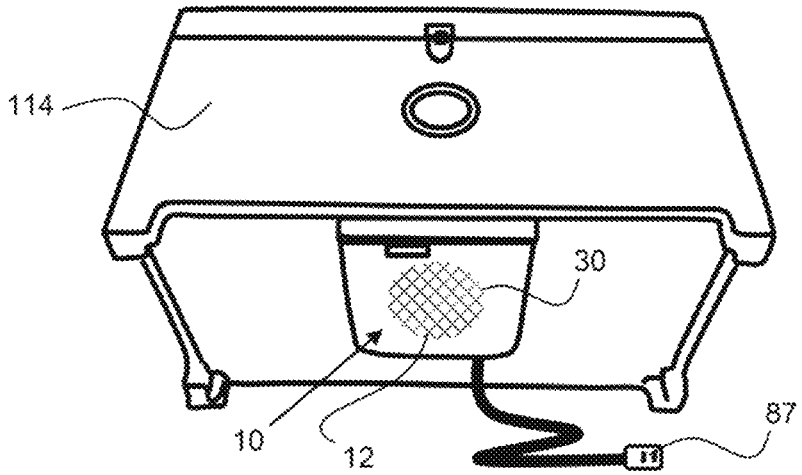
FIG. 17 show a bottom perspective view of the humidor shown in FIG. 16 with an exemplary environment control system coupled to the bottom.

As shown in FIGS. 16 and 17, an exemplary environment control system 10 is configured to control the environment within a humidor 114. The top of the humidor, as shown in FIG. 16 has a door 11 to form an enclosure 50. The environment control system 10 is configured on the bottom of the humidor, as shown in FIG. 17, and may control the level of oxygen and/or humidity within the humidor enclosure.

Figure 18:
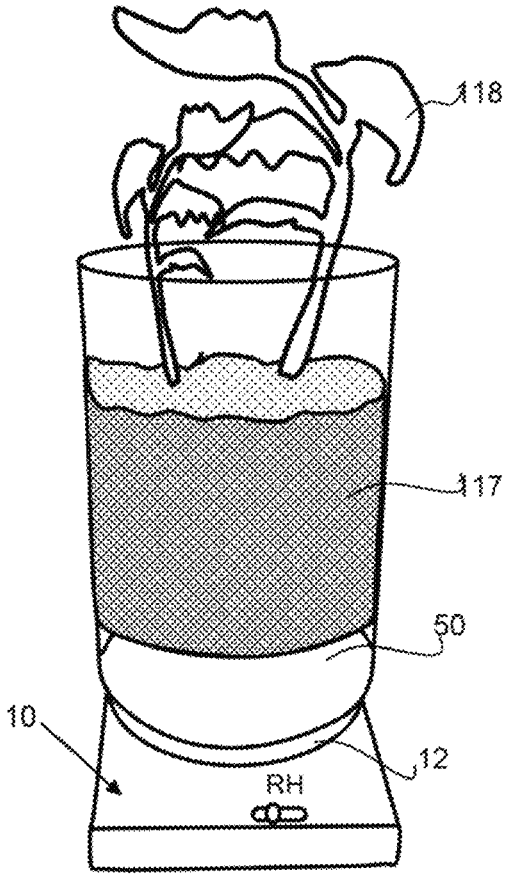
FIG. 18 shows a side view of an exemplary environment control system configured to control the environment of growing enclosure, such as a vase or pot for growing a plant.

As shown in FIG. 18, an exemplary environment control system 10 is configured to control the environment of growing enclosure 117, such as a vase or pot for growing a plant. The environment control system 10 may control the humidity and/or oxygen level of the space below the plant or dirt within the enclosure 50.

Figure 19:
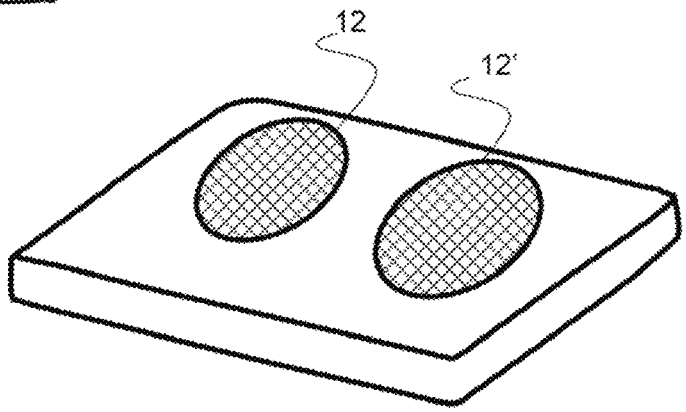
FIG. 19 shows a perspective vie of an exemplary environment control system having two electrolyzer cells for placement of an enclosure thereon.

As shown in FIG. 19, an exemplary environment control system 10 has two electrochemical cells 12,12' for placement of an enclosure thereon.

Figure 20:
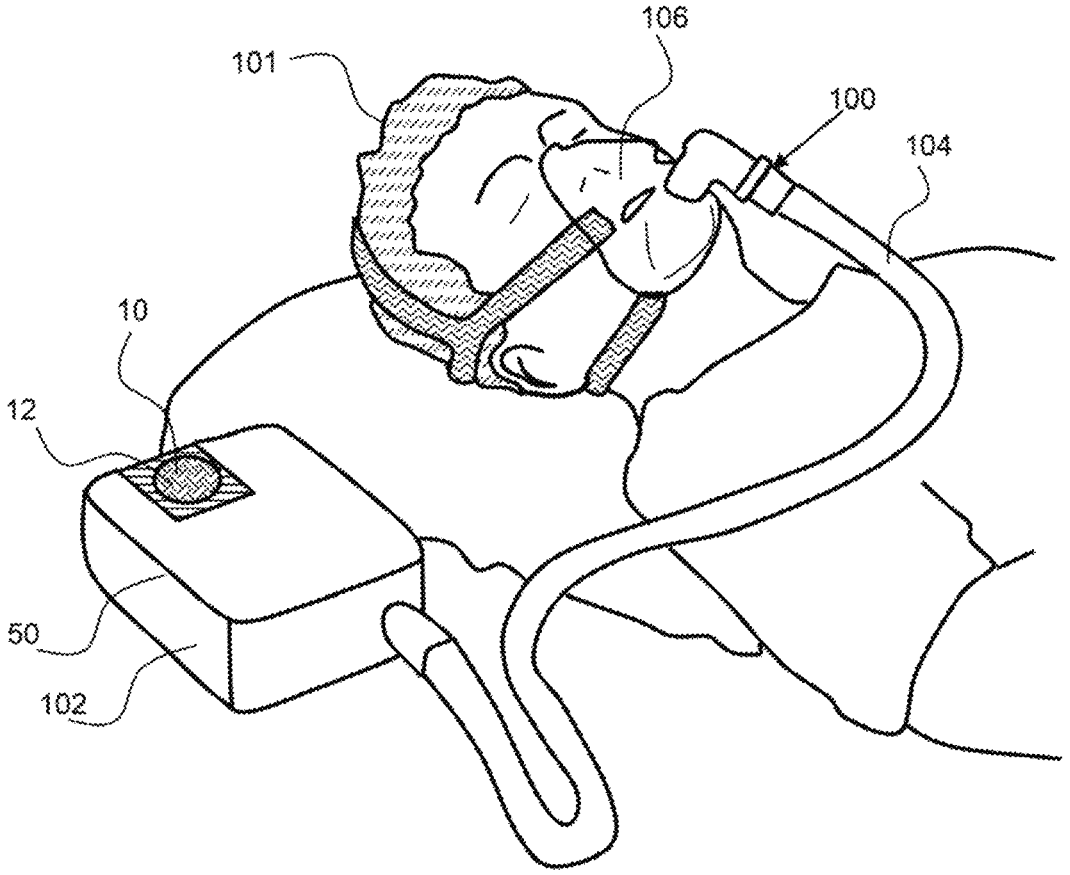
FIG. 20 show a person sleeping with the aid of a Positive Airway Pressure, PAP, device having an exemplary environment control system.

FIG. 20 shows a person 101 sleeping with the aid of a Positive Airway Pressure (PAP) device 100. The PAP device or breathing device has a flow generator (PAP machine) 102 that provides the airflow to the hose 104 that connects the patient interface 106. The hose connects the flow generator (sometimes via an in-line humidifier) to the interface 106. An interface includes, but is not limited to, a nasal or full face mask, nasal pillows, or less commonly a lip-seal mouthpiece, provides the connection to the user's airway or respiratory system, such as through the nose or mouth. An exemplary environment control system 10 is attached to the flow generator 102 or enclosure of the flow generator 50 and may be used to increase the level of oxygen and/or humidity within the pressurized flow delivered to the person. A PAP device, as used herein, includes all of the variations of breathing aid devices described herein.

Figure 21:
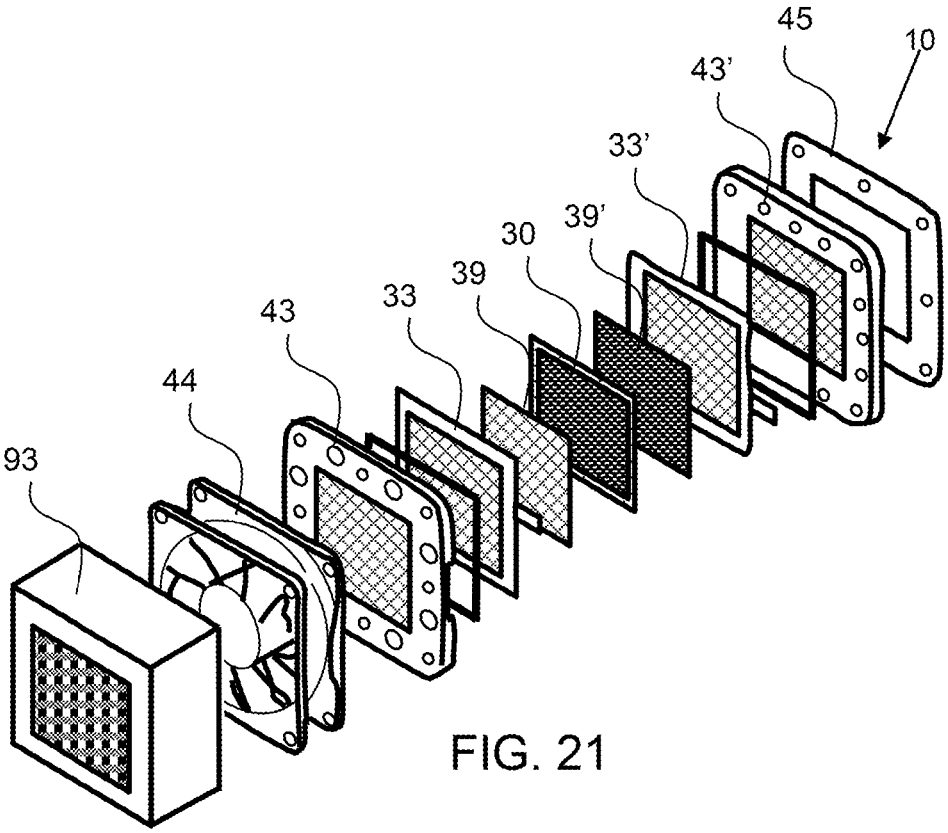
FIG. 21 shows a perspective exploded view of an exemplary electrolyzer cell.

As shown in FIG. 21, an exemplary electrolyzer cell comprises a filter 94, MEA fan 44, housing components 43, 43', flow fields 38, 38', current collector 33, membrane electrode assembly 30, gas diffusion media 39, and a gasket 45. This assembly has a fan configured to blow air directly onto the MEA 30. As described herein, this improves performance of the MEA.

Figure 22:
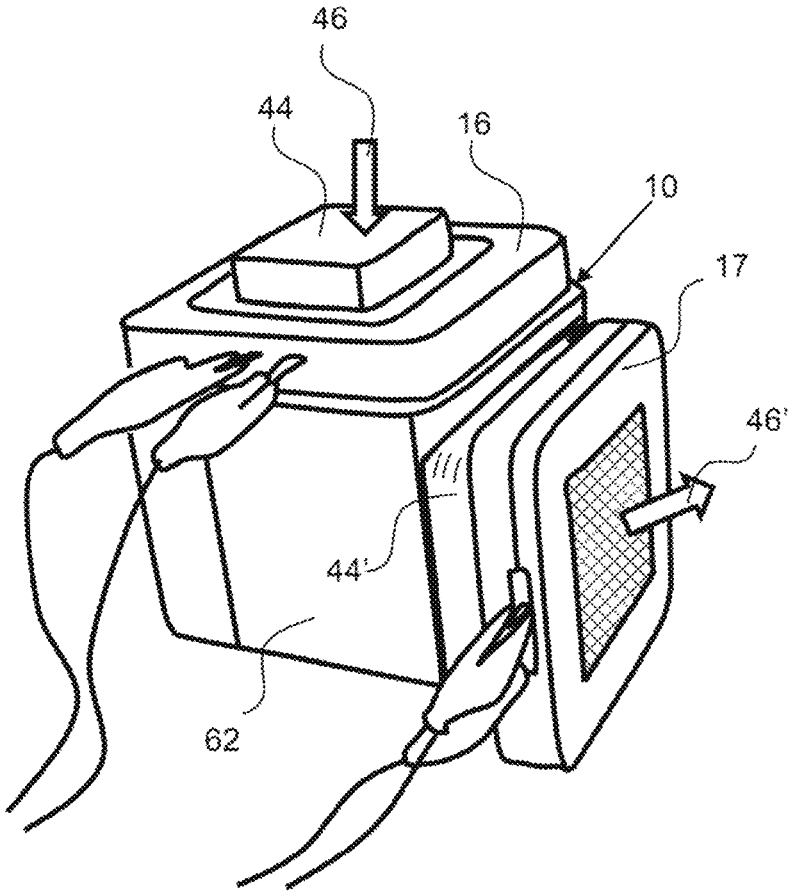
FIG. 22 show a perspective view of an exemplary environment control device.

As shown in FIG. 22, an exemplary environment control device 10 comprises an oxygen control electrolyzer cell 16 and a humidity control electrolyzer cell 17 configured around a conditioner chamber 62. An MEA air moving device 44, such as a fan, is configured to produce a flow of process air 46, which is a flow of forced air, onto the anode of the oxygen control electrolyzer cell 16. As described herein, this greatly increases the efficiency of the oxygen control electrolyzer cell 16. The air moving device 44 is coupled directly to the MEA and has close proximity to the anode which may be important for improved efficiency. An MEA air moving device 44', such as a fan, is configured between the humidity control electrolyzer cell 17 and the conditioner chamber 62 to produce a flow of process air 46' onto the anode of the humidity control electrolyzer cell 17. This fan may be configured within the conditioner chamber with the MEA of the humidity control electrolyzer cell being sealed against the conditioner chamber. Electrical contacts are coupled to each of the electrolyzer cells to provide a potential across the anode and cathode.

Figure 23:
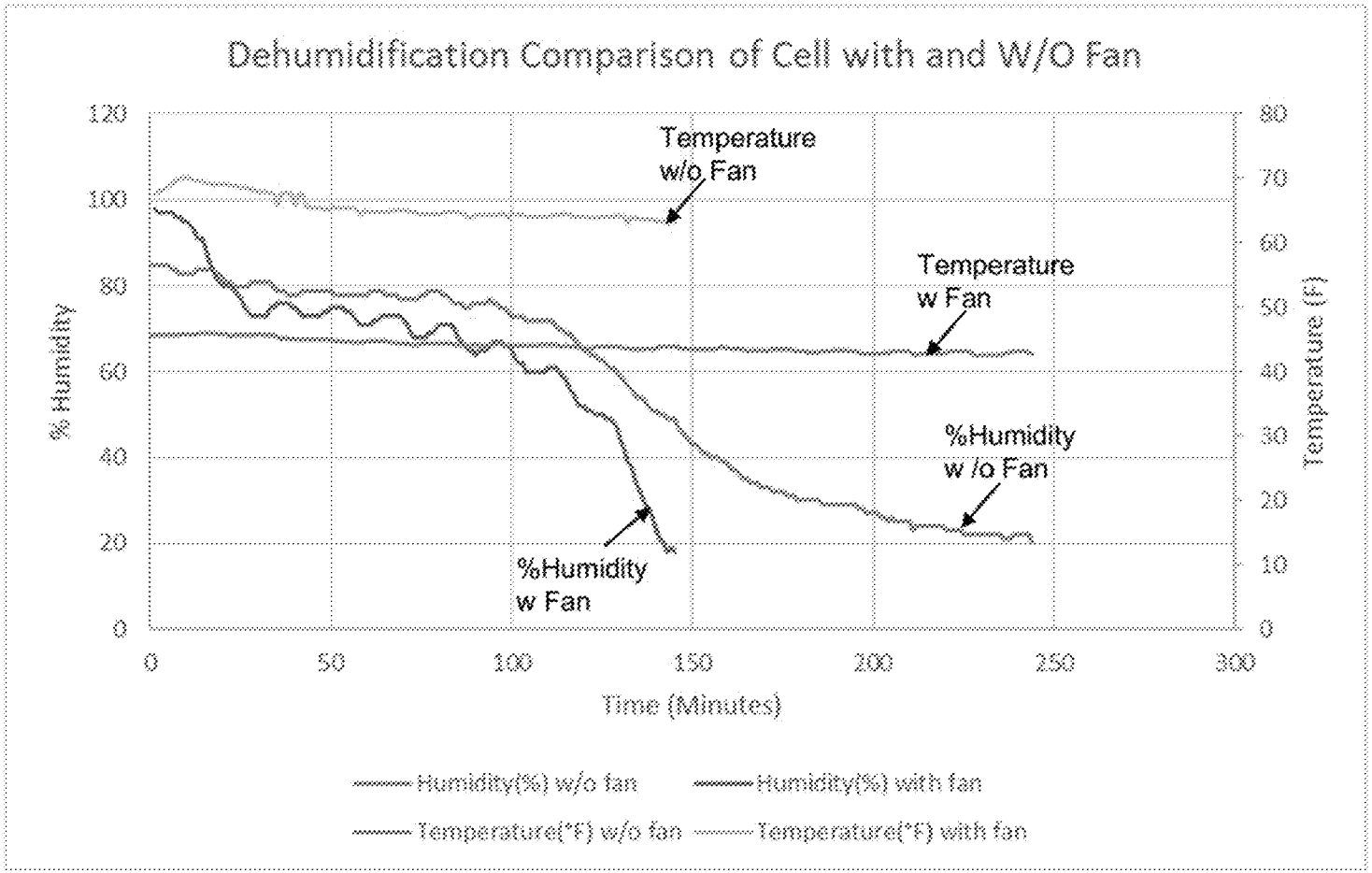
FIG. 23 shows a graph of an enclosure temperature and humidity with and without a fan blowing onto the cathode of a humidity control electrolyzer.

FIG. 23 shows a graph an enclosure temperature and humidity with and without a fan blowing onto the anode of a humidity control electrolyzer. The data shows that the humidity was reduced much more quickly when the electrolyzer was operated with a fan blowing directly onto the MEA to produce a flow of process air, or forced air, onto the anode of the humidity control electrolyzer cell.

Figure 24:
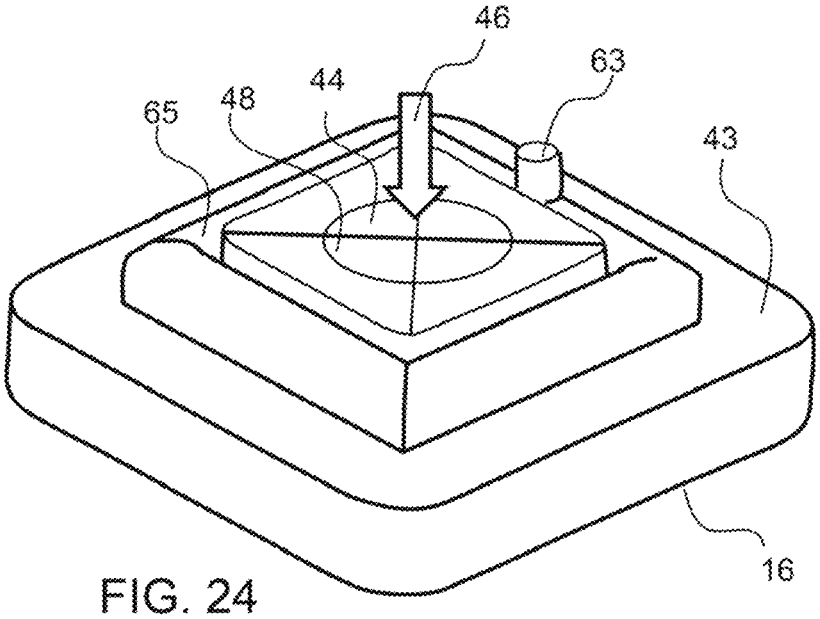
FIG. 24 shows a perspective view of exemplary oxygen control electrolyzer cell configured with an MEA air moving device to produce a flow of process air onto the anode of the membrane electrode assembly
Figure 25:
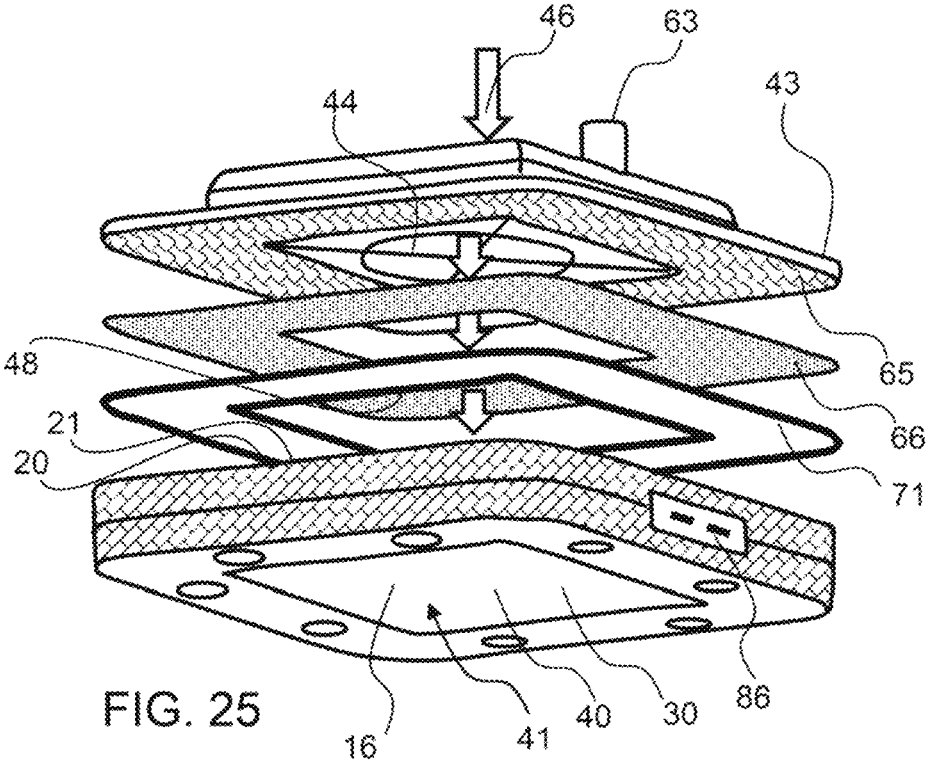
FIG. 25 shows an exploded view of an exemplary oxygen control electrolyzer cell configured with an MEA air moving device to produce a flow of process air onto the anode of the membrane electrode assembly

Referring now to FIGS. 24 and 25, an exemplary oxygen control electrolyzer cell 16, is configured with an MEA air moving device 44, such as a fan, configured to produce a flow of process air 46 onto the anode 20 of the membrane electrode assembly 30. A water chamber 65 is configured around a forced air opening 48 to allow the forced air to impinge directly onto the MEA or anode 20 of the MEA. A pervaporation layer 66 that allows the transport of water therethrough, but prevents the bulk flow of air, extends around the forced air opening to provide water or moisture to the MEA. A gasket 71 seals the pervaporation layer to the MEA. The flow of process air impinges directly onto the anode side 21 of the MEA 30 and the cathode side 41 or cathode 40 of the MEA may be sealed to a conditioner chamber, not shown. A data interface 86 is configured to allow coupling of a data storage and/or a data transmitter. Data related to the environment control device, such as humidity level, oxygen level, temperature, MEA voltage potential and the like may be stored and/or transferred to remote location. A fill port 63 for receiving fluid, such as water for hydrating the ion conducting media, such as an ionomer is shown. The port may receive water or fluid from a condenser of the conditioner chamber, or it may be manually filled, or attached to an automatic filing system, wherein when the water chamber 65 drops below a certain level, a valve on the fill port fills the water chamber above a threshold level.

Figure 26:
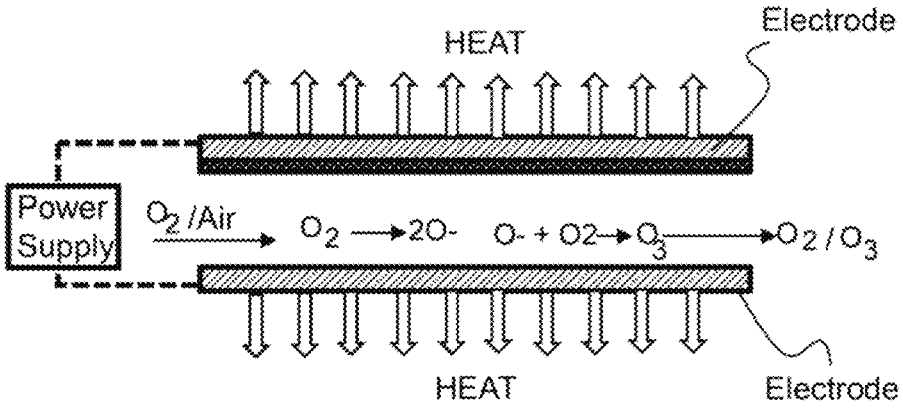
FIG. 26 shows a diagram of a corona discharge ozone generating device.

FIG. 26 shows a diagram of a corona discharge ozone generating device.

Figure 27:
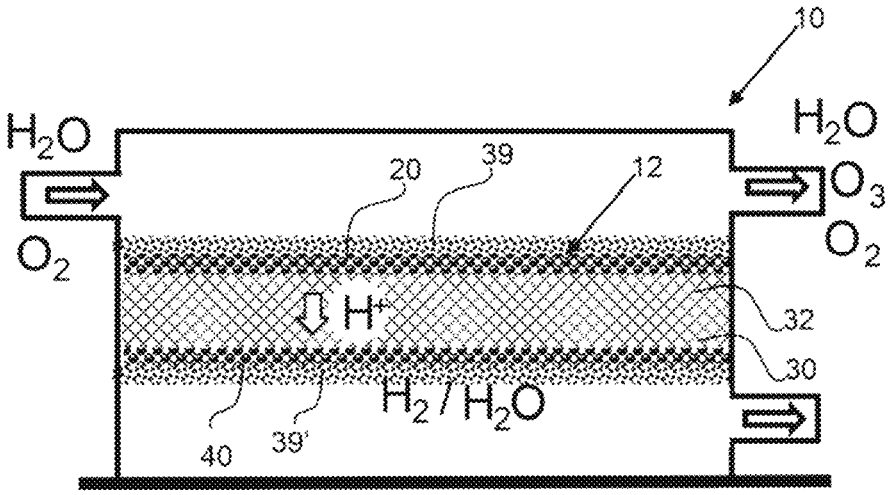
FIG. 27 shows an exemplary ozone generating electrode assembly connected to a circuit for power, wherein electrolysis of water on the anode side produces protons that are transported across the ion conducting membrane to the cathode side.

As shown in FIG. 27, an exemplary ozone generator 11 produces ozone when the potential across the anode and cathode of an electrochemical cell is 1.51 and higher. The electrochemical cell 12 has an anode 20, cathode 40 and proton conducting layer 32 therebetween. Water or water vapor, such as from air, is converted by reaction on the anode 20 to ozone. Protons are passed through the proton conducting layer 32 to the cathode 40, where they react to form hydrogen or when oxygen is present water. The membrane electrode assembly 30 comprising the proton conducting layer, anode and cathode effectively produces ozone from ambient air having some water vapor. Water will be formed on the cathode if oxygen is present.

Figure 28:
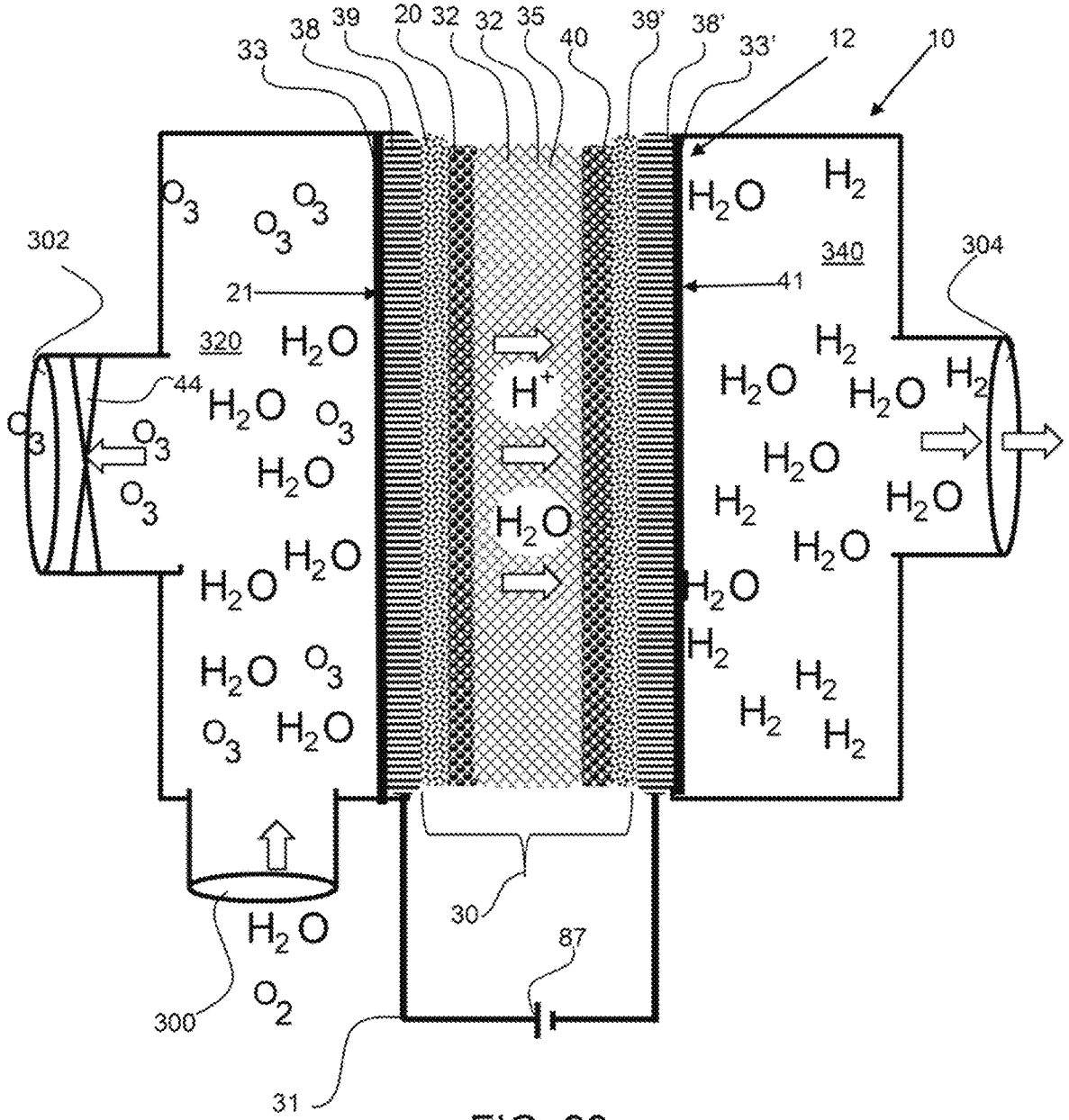
FIG. 28 shows an exemplary ozone generator system comprising a membrane electrode assembly, MEA, a part of the electrochemical cell coupled with an enclosure and producing ozone within the enclosure.

As shown in FIG. 28 an exemplary ozone generator system 10 comprises an exemplary electrochemical cell 12 having a proton conducting layer 32 with electrodes, gas diffusion material 39, 39' and conductor plates 33,33' on either side of the proton conducting layer. The ozone generator 11 produces ozone on the anode 20 while water and/or hydrogen is produced on the cathode 40, depending on the availability of oxygen on the cathode side. Ozone is being generated on the anode side 21 and hydrogen is being produced on the cathode side 41 of the electrochemical cell 12. The exemplary ozone generator has an anode chamber 320 and a cathode chamber 340. The exemplary membrane electrode assembly 30 is connected to a circuit 31 for power from a power source 87. When the potential across the membrane electrode assembly 30 exceeds 1.51V, protons are produced on the anode side and transported across the proton conducting layer 32 to the cathode side 41. On the cathode side, the protons are reacted with electrons to produce hydrogen and/or water. The protons also drag water across the MEA from the anode side to the cathode side. The membrane electrode assembly is coupled between two electrical conductor plates 33, 33' to provide the electrical power to the MEA. An electrical conductor plate, may be a screen or perforated and may be the gas diffusion media and/or a flow field. A separate gas diffusion media 39, 39' may be configured between the conductor plates and the membrane electrode assembly. A flow field 38, 38' may have a plurality of channels for distributing gasses to the surface of the MEA or gas diffusion media.

Figure 29:
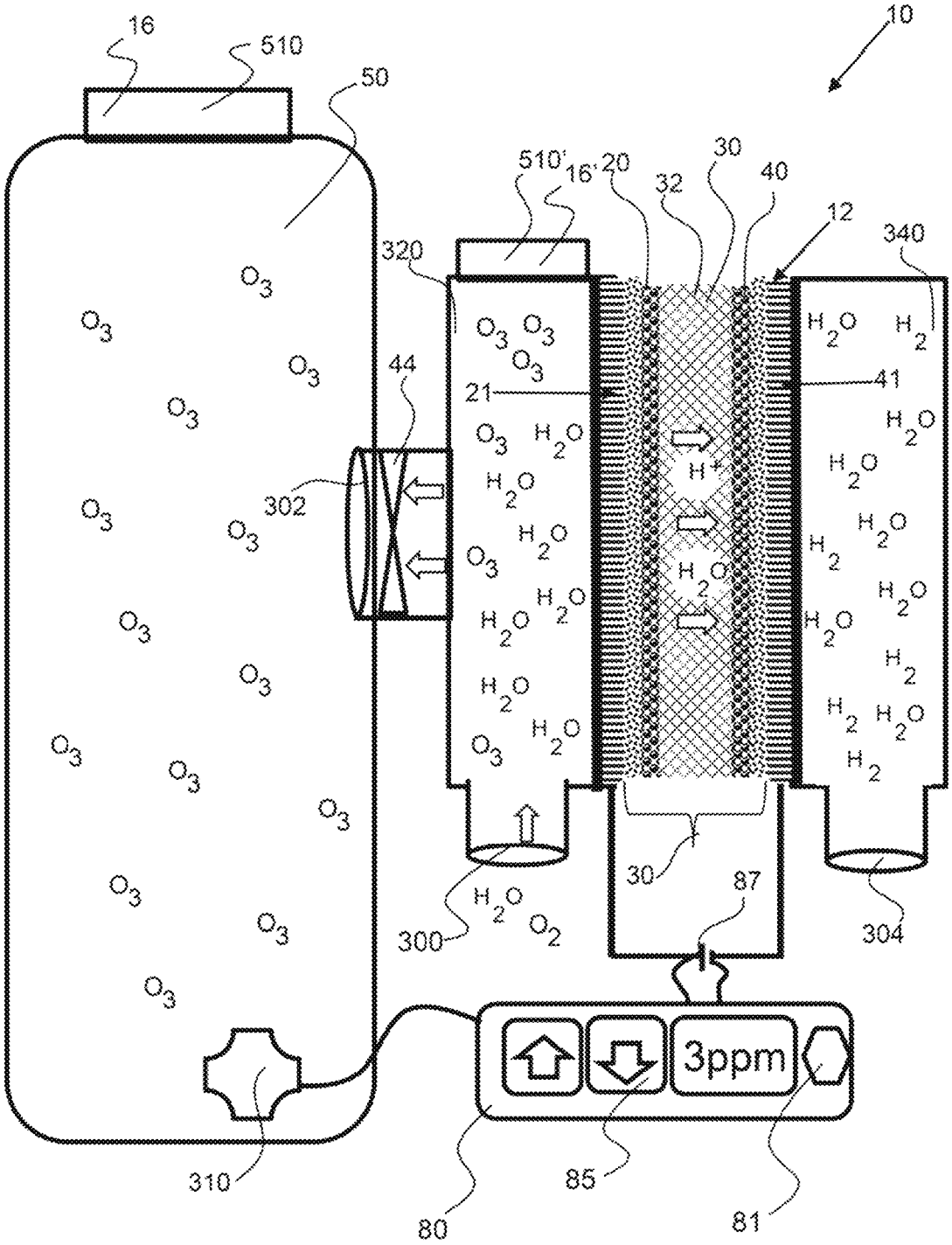
FIG. 29 shows an exemplary ozone generator system in fluid communication with an enclosure.

As shown in FIG. 29, an exemplary ozone generator system 10 is coupled with an enclosure 50 and the anode side 21 is fluidly coupled with the enclosure. A power supply 87 provides a potential across the anode 20 and cathode 40 that causes water to be reacted on the anode side 21 and form ozone. The ozone concentration within the enclosure can be controlled by the controller system 80 and user interface 85. As shown, the ozone sensor 310 detects 3 ppm of ozone within the enclosure. The desired concentration of ozone within the enclosure can be changed by interfacing with the user interface. A control system 80 may comprise a microprocessor 81 to adjust and control the components of the ozone generator system 310 to provide a desired concentration of ozone. An inlet 300 to the anode 20 provides an exchange air to support the reaction. The ozone produced on the anode side 21 is transported into the enclosure 50 through an anode side outlet 302. A fan or other fluid moving device 44 may control the rate of flow of the fluid from the anode to the enclosure. The controller may control the fluid moving device flow rate. Water and/or hydrogen produce on the cathode side 41 is exhausted out of the cathode side exhaust 304.

As shown in FIG. 29, an exemplary micro climate control device 510, such as an oxygen control electrolyzer cell 16 is in fluid communication with the enclosure 50 and a second micro climate control device 510', such as an oxygen control electrolyzer cell 16' is in fluid communication with the anode chamber 320 to control a humidity level therein. PCT application US2016063699, hereby incorporated by reference, describes a novel proton-exchange membrane (PEM) based solid polymer electrolyte electrochemical oxygen control (EOC) system incorporating an oxygen control electrolyzer cell that can deplete and control the oxygen within an enclosure. In addition, this application describes a control of humidity levels within an enclosure utilizing said oxygen control electrolyzer cell 16. The oxygen levels within an enclosure can be controlled fix any suitable purpose such as for disinfestation and/or preservation of articles within an enclosure. IN addition, humidity levels can be controlled for preservation of items within an enclosure. Humidity may be provided to an anode chamber 320 by the micro climate control device 510' as required. This would ensure a clean supply of water vapor to the anode. Likewise, the water vapor may be drawn out of the enclosure 50 by the micro climate control device 510. Note that an ozone generator system may be in fluid communication with the enclosure but may not require and anode chamber or anode inlet 300. The ozone generator may react with moisture within the enclosure to produce ozone.

Figure 30:
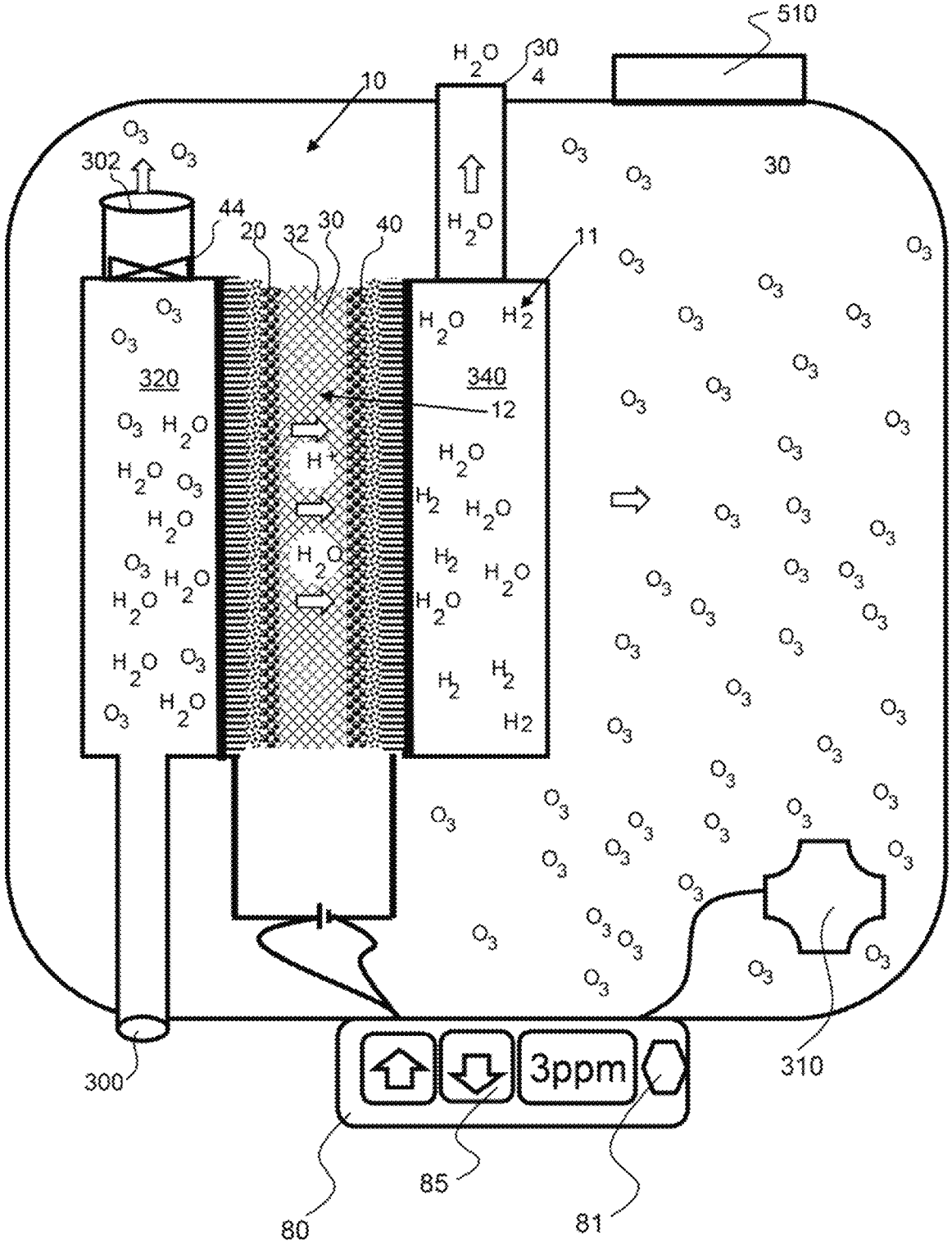
FIG. 30 shows an exemplary ozone generator system configured at least partially within an enclosure.

As shown in FIG. 30, an exemplary ozone generator system 10 comprises an ozone generator 11 that is configured at least partially within the enclosure 50. The entire ozone generator 11 may be configured within the enclosure and the anode side inlet 300 may extend out from the enclosure and the cathode side outlet 304 may extend out from the enclosure. Note that the cathode side may have an inlet conduit to provide a flow of oxygen or air to allow water to be formed on the cathode side.

Figure 31:
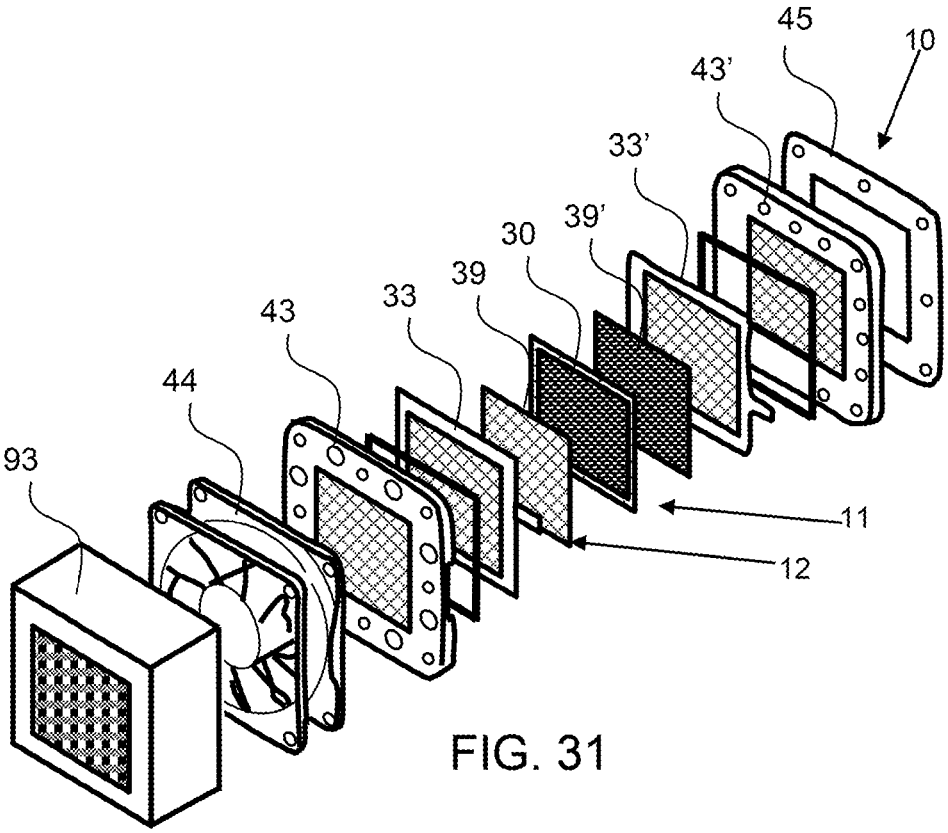
FIG. 31 shows a perspective view of the components of an exemplary environment control system having a fan that directs air over the anode.

FIG. 31 shows a perspective view of the components of an exemplary ozone generator system 10 having an air or fluid moving device 44, such as a fan, that directs air over the anode or into an anode chamber. A filter 93 may be configured to remove contaminates from an incoming air stream. The membrane electrode assembly 30 and other components are configured in a housing 43, 43. A conductor plates 33' is configured to provide the potential required to drive the reactions. A gas diffusion media, such as a carbon cloth, is configured adjacent the MEA in this embodiment.

The fan 44 attached to the housing is designed to create airflow on the surface of the membrane/catalyst to transfer moisture and break up surface tension to improve performance significantly. The flow of air through a duct across the anode side of the cell is another way of achieving a performance increase. It can be used in addition to the fan being placed directly on the Surface of the cell but does not generate as much increased performance. There are effects that can be attributed to this higher performance that can be linked to higher pressure on the surface and trapping/increasing moisture from the close proximity of the fan. The fan in this case has a cowl induction type of frame that captures the air flow and moisture around the fan and channels it to the cell. Higher speed fans without the cowl induction could compensate for the air flow losses. Results from placing the fan directly on the cell and channeling the air and humidity have shown to make the cell perform at least 3 times better than without the close air turbulence.

Figure 32:
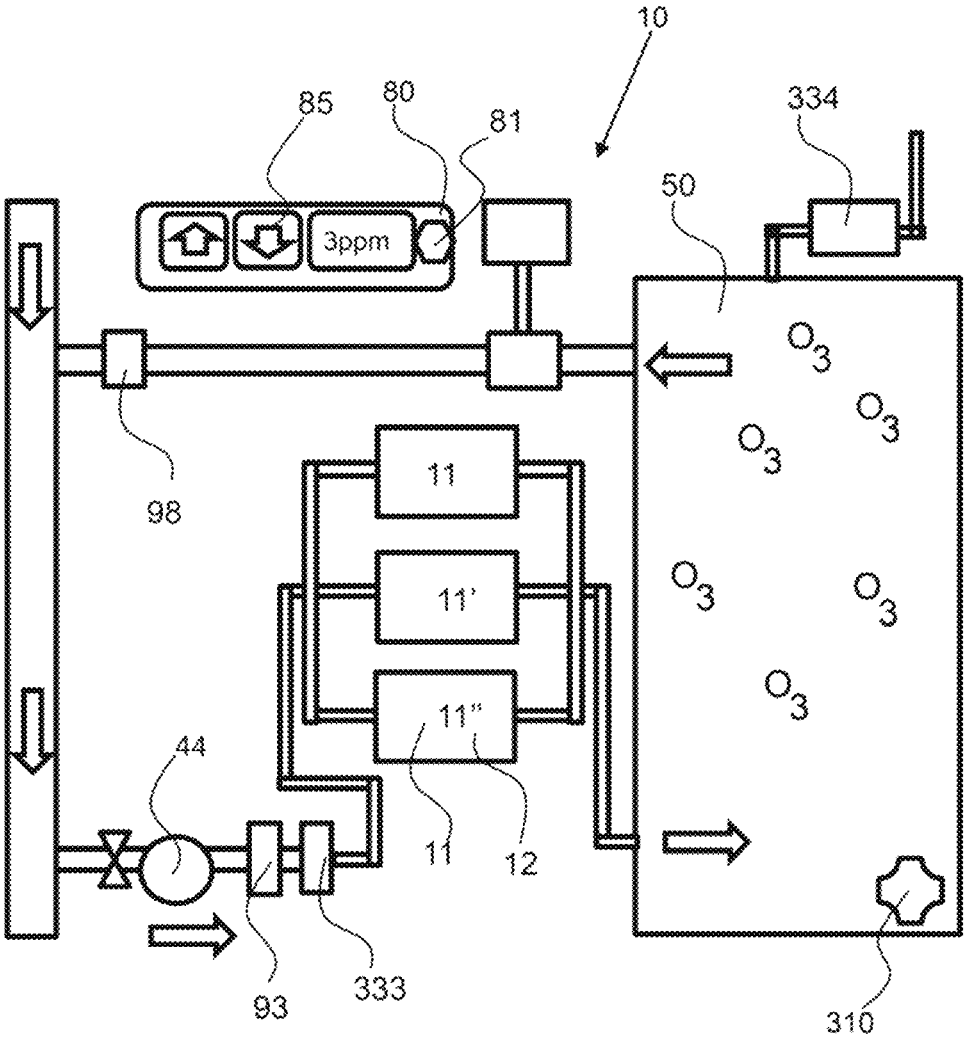
FIG. 32 shows a diagram or an exemplary ozone generator device having a plurality of ozone generators coupled with an enclosure, or control tank, as shown.

FIG. 32 shows a diagram of an exemplary ozone generator system 10 having three of ozone generators 11-11" coupled with an enclosure 50, or control tank. An air moving device 44 provides air or process fluid to the anode side of the ozone generators 11, and ozone is produced and fed to the enclosure 50. An ozone depletion module 334 may be used to reduce the concentration of the ozone in the enclosure if it becomes too high, as determined by the ozone sensor 310. The ozone in the enclosure may be pumped to a second enclosure or over articles for disinfection as required by the application. The control system 80 may be used to specify the concentration of ozone desired and the controller may change the voltage and flow gas to achieve the desired concentration. The system may have a number of valves 98 that open, close and/or constrict flow therethrough. A flow meter may be used to control the flow of air or process fluid to the ozone generators 11-11". The control system may control all of these components to produce ozone at a desired concentration and to produce a flow of ozone to a desired location.

Fluid communication, as used herein, means that gasses can flow to and from the two items described to be in fluid communication. For example, the cathode of an oxygen reduction electrolyzer cell may be in fluid communication with the oxygen control chamber, wherein the reaction products from the anode can freely now into the oxygen control chamber.

The electrochemical cells, 12 shown in the figures may run as electrolyzer cells, as described herein that perform electrolysis of water, wherein water is broken down on the anode into protons and oxygen and reformed on the cathode with the protons and oxygen.

The electrochemical cells can be operated at higher potentials to produce ozone, which may be used to clean and disinfect the enclosure.

When an electrochemical cell is operated at a potential above 12 volts, electrolysis of water will occur and when operated above 2.08 volts, ozone may be produced.

Dehumidification device, as used herein, is a device that reduces the humidity level or RH and includes, but is not limited to, a desiccant or desiccator employing a desiccant, a condenser and a humidity reduction electrolyzer cell.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An ozone generator system that is coupled with an enclosure and comprises:

a) an ozone producing electrochemical cell;

wherein an ozone concentration within the enclosure is increased by the electrochemical cell;

b) an environment control system that is coupled with the enclosure and comprises:

an oxygen control electrolyzer cell, wherein the oxygen control electrolyzer cell comprises:

i) an ion exchange medium;

ii) an anode;

iii) a cathode;

wherein the anode and cathode are configured on opposing sides of the ion exchange medium;

wherein the oxygen control electrolyzer cell is in fluid communication with said enclosure; and wherein a power source is coupled with the anode and cathode to provide an electrical potential across the anode and the cathode to initiate electrolysis of water, wherein water is reacted to form products on the anode and the cathode to control the humidity level of the enclosure;

c) a controller that is coupled with the power source and the oxygen control electrolyzer cell to control electrical potential across the anode and the cathode;

wherein an oxygen concentration within the enclosure is controlled by the oxygen control electrolyzer and a humidity level is controlled within the enclosure by a humidity control device; and wherein the environment control system is fluidly coupled with an anode chamber of the ozone generator, and wherein the environment control system produces water that is provided to the anode of the ozone generator.

2. The ozone generator system of claim 1, further comprising a humidity control device.

* * * * *